US008142272B2

(12) United States Patent
Walker et al.

(10) Patent No.: US 8,142,272 B2
(45) Date of Patent: Mar. 27, 2012

(54) METHOD AND APPARATUS FOR FACILITATING ENTRY INTO BONUS ROUNDS

(75) Inventors: Jay S. Walker, Ridgefield, CT (US); James A. Jorasch, New York, NY (US); Geoffrey M. Gelman, Boston, MA (US)

(73) Assignee: IGT, Reno, NV (US)

( * ) Notice: Subject to any disclaimer, the term of this patent is extended or adjusted under 35 U.S.C. 154(b) by 1207 days.

(21) Appl. No.: 11/160,150

(22) Filed: Jun. 10, 2005

(65) Prior Publication Data

US 2006/0035696 A1 Feb. 16, 2006

Related U.S. Application Data

(63) Continuation-in-part of application No. 10/784,845, filed on Feb. 23, 2004, now Pat. No. 7,427,233.

(51) Int. Cl.
*A63F 9/00* (2006.01)

(52) U.S. Cl. ..... 463/16

(58) Field of Classification Search ..... 463/20
See application file for complete search history.

(56) References Cited

U.S. PATENT DOCUMENTS

| | | | | |
|---|---|---|---|---|
| 4,184,683 A | | 1/1980 | Hooker | 273/143 |
| 4,305,586 A | * | 12/1981 | Richards | 273/274 |
| 4,448,419 A | | 5/1984 | Telnaes | 273/143 R |
| 4,570,934 A | | 2/1986 | Smyth | 273/143 |
| 4,669,731 A | | 6/1987 | Clarke | 273/143 |
| 4,679,143 A | | 7/1987 | Hagiwara | 364/412 |
| 4,695,053 A | | 9/1987 | Vazquez, Jr. et al. | 273/143 R |
| 4,760,245 A | | 7/1988 | Fukaya | 235/379 |
| 4,856,787 A | | 8/1989 | Itkis | 273/237 |
| 4,939,705 A | | 7/1990 | Hamilton et al. | 368/10 |
| 4,991,848 A | | 2/1991 | Greenwood et al. | 273/143 R |
| 5,083,271 A | | 1/1992 | Thacher et al. | 364/411 |
| 5,108,099 A | | 4/1992 | Smyth | 273/138 |

(Continued)

FOREIGN PATENT DOCUMENTS

GB 2 144 644 3/1985

(Continued)

OTHER PUBLICATIONS

Fey, Marshall, "Slot Machines—A Pictoral History of the First 100 Years", Liberty Belle Books, First Printing 1983, p. 89.

(Continued)

*Primary Examiner* — Melba Bumgarner
*Assistant Examiner* — Seng H Lim
(74) *Attorney, Agent, or Firm* — K&L Gates LLP

(57) ABSTRACT

The present invention allows gaming devices to set or modify game parameters through the use of random events such as spinning slot machine reels and/or random number generators. In one embodiment, a player may purchase an entry into a bonus round of a bonus game, without first having to qualify for the entry by obtaining a qualifying outcome of a base game. In one embodiment, a player may provide payment for an entry into one or more bonus rounds to establish an initial credit meter balance, wherein the initial credit meter balance is set to a number of credits based on the results of the one or more bonus rounds and not to an amount of credits corresponding to the payment provided by the player, wherein the player can pay for the entry without first having to qualify for the entry via a qualifying outcome of the base game.

24 Claims, 12 Drawing Sheets

U.S. PATENT DOCUMENTS

| | | | | | |
|---|---|---|---|---|---|
| 5,123,649 | A | | 6/1992 | Tiberio | 273/143 |
| 5,178,390 | A | | 1/1993 | Okada | 273/143 |
| 5,179,517 | A | | 1/1993 | Sarbin et al. | 364/410 |
| 5,242,163 | A | | 9/1993 | Fulton | 273/85 CP |
| 5,259,616 | A | | 11/1993 | Bergmann | 273/138 A |
| 5,275,400 | A | | 1/1994 | Weingardt et al. | 273/85 CP |
| 5,277,424 | A | | 1/1994 | Wilms | 273/85 CP |
| 5,342,047 | A | | 8/1994 | Heidel et al. | 273/85 CP |
| 5,356,140 | A | | 10/1994 | Dabrowski et al. | 273/85 CP |
| 5,370,399 | A | | 12/1994 | Liverance | 273/434 |
| 5,393,057 | A | | 2/1995 | Marnell, II | 273/85 CP |
| 5,393,061 | A | * | 2/1995 | Manship et al. | 463/20 |
| 5,401,023 | A | | 3/1995 | Wood | 273/85 CP |
| 5,409,225 | A | | 4/1995 | Kelly et al. | 273/138 R |
| 5,449,173 | A | | 9/1995 | Thomas et al. | 273/143 |
| 5,494,287 | A | | 2/1996 | Manz | 273/143 R |
| 5,511,784 | A | | 4/1996 | Furry et al. | 273/143 R |
| 5,542,669 | A | * | 8/1996 | Charron et al. | 463/13 |
| 5,544,892 | A | | 8/1996 | Breeding | 273/292 |
| 5,559,312 | A | | 9/1996 | Lucero | 235/380 |
| 5,564,700 | A | | 10/1996 | Celona | 463/27 |
| 5,580,308 | A | | 12/1996 | Nakamura | 463/7 |
| 5,580,309 | A | | 12/1996 | Piechowiak et al. | 463/16 |
| 5,603,502 | A | | 2/1997 | Nakagawa | 273/292 |
| 5,611,730 | A | | 3/1997 | Weiss | 463/20 |
| 5,639,088 | A | | 6/1997 | Schneider et al. | 273/138.2 |
| 5,655,961 | A | * | 8/1997 | Acres et al. | 463/27 |
| 5,664,998 | A | | 9/1997 | Seelig et al. | 463/20 |
| 5,695,400 | A | | 12/1997 | Fennell, Jr. et al. | 463/42 |
| 5,695,402 | A | | 12/1997 | Stupak | 463/20 |
| 5,697,843 | A | | 12/1997 | Manship et al. | 463/20 |
| 5,702,304 | A | | 12/1997 | Acres et al. | 463/29 |
| 5,704,835 | A | | 1/1998 | Dietz, II | 463/20 |
| 5,720,662 | A | | 2/1998 | Holmes, Jr. et al. | 463/20 |
| 5,722,891 | A | | 3/1998 | Inoue | 463/20 |
| 5,741,183 | A | | 4/1998 | Acres et al. | 463/42 |
| 5,755,621 | A | | 5/1998 | Marks et al. | 463/42 |
| 5,761,647 | A | | 6/1998 | Boushy | 705/10 |
| 5,770,533 | A | | 6/1998 | Franchi | 463/ 42 |
| 5,800,264 | A | | 9/1998 | Pascal et al. | 463/16 |
| 5,811,772 | A | | 9/1998 | Lucero | |
| 5,823,875 | A | * | 10/1998 | Tarantino | 463/29 |
| 5,823,879 | A | | 10/1998 | Goldberg et al. | 463/42 |
| 5,833,537 | A | | 11/1998 | Barrie | 463/21 |
| 5,833,538 | A | | 11/1998 | Weiss | 463/21 |
| 5,833,540 | A | | 11/1998 | Miodunski et al. | 463/42 |
| 5,836,586 | A | | 11/1998 | Marks et al. | 273/292 |
| 5,848,932 | A | | 12/1998 | Adams | 463/20 |
| 5,851,147 | A | | 12/1998 | Stupak et al. | 463/13 |
| 5,882,260 | A | | 3/1999 | Marks et al. | 463/13 |
| 5,910,048 | A | | 6/1999 | Feinberg | 463/25 |
| 5,916,024 | A | | 6/1999 | Von Kohorn | |
| 5,967,896 | A | * | 10/1999 | Jorasch et al. | 463/25 |
| 5,979,702 | A | | 11/1999 | Hennessey et al. | 221/206 |
| 5,980,384 | A | | 11/1999 | Barrie | 463/16 |
| 5,997,400 | A | | 12/1999 | Seelig et al. | 463/6 |
| 5,997,401 | A | | 12/1999 | Crawford | 463/20 |
| 6,004,207 | A | | 12/1999 | Wilson, Jr. et al. | 463/20 |
| 6,019,374 | A | | 2/2000 | Breeding | 273/292 |
| 6,033,307 | A | | 3/2000 | Vancura | 463/20 |
| 6,039,648 | A | | 3/2000 | Guinn et al. | 463/16 |
| 6,047,963 | A | * | 4/2000 | Pierce et al. | 273/121 B |
| 6,068,552 | A | | 5/2000 | Walker et al. | 463/21 |
| 6,077,162 | A | | 6/2000 | Weiss | 463/26 |
| 6,077,163 | A | | 6/2000 | Walker et al. | 463/26 |
| 6,089,975 | A | | 7/2000 | Dunn | 463/16 |
| 6,093,100 | A | | 7/2000 | Singer et al. | 463/13 |
| 6,110,043 | A | | 8/2000 | Olsen | 463/27 |
| 6,113,102 | A | | 9/2000 | Marks et al. | 273/292 |
| 6,135,882 | A | | 10/2000 | Kadlic | 463/13 |
| 6,142,872 | A | | 11/2000 | Walker et al. | 463/16 |
| 6,173,955 | B1 | * | 1/2001 | Perrie et al. | 273/146 |
| 6,190,256 | B1 | * | 2/2001 | Walker et al. | 463/25 |
| 6,203,430 | B1 | | 3/2001 | Walker et al. | 463/20 |
| 6,227,972 | B1 | * | 5/2001 | Walker et al. | 463/25 |
| 6,264,560 | B1 | | 7/2001 | Goldberg et al. | 463/42 |
| 6,270,409 | B1 | | 8/2001 | Shuster | 463/20 |
| 6,270,412 | B1 | | 8/2001 | Crawford et al. | 463/20 |
| 6,287,202 | B1 | | 9/2001 | Pascal et al. | 463/42 |
| 6,299,534 | B1 | * | 10/2001 | Breeding et al. | 463/25 |
| 6,305,686 | B1 | * | 10/2001 | Perrie et al. | 273/146 |
| 6,311,976 | B1 | * | 11/2001 | Yoseloff et al. | 273/138.2 |
| 6,312,332 | B1 | | 11/2001 | Walker et al. | 463/23 |
| 6,315,665 | B1 | | 11/2001 | Faith | |
| 6,319,122 | B1 | * | 11/2001 | Packes et al. | 463/16 |
| 6,328,649 | B1 | * | 12/2001 | Randall et al. | 463/20 |
| 6,332,128 | B1 | | 12/2001 | Nichholson | 705/14 |
| 6,336,863 | B1 | | 1/2002 | Baerlocher et al. | |
| 6,345,824 | B1 | * | 2/2002 | Selitzky | 273/292 |
| 6,364,765 | B1 | | 4/2002 | Walker et al. | 463/16 |
| 6,371,852 | B1 | * | 4/2002 | Acres | 463/25 |
| 6,375,570 | B1 | * | 4/2002 | Poole | 463/31 |
| 6,471,589 | B1 | | 10/2002 | Nagano | 463/21 |
| 6,481,713 | B2 | * | 11/2002 | Perrie et al. | 273/146 |
| 6,520,856 | B1 | | 2/2003 | Walker et al. | 280/735 |
| 6,599,186 | B1 | * | 7/2003 | Walker et al. | 463/17 |
| 6,606,602 | B1 | | 8/2003 | Kolls | 705/14 |
| 6,620,045 | B2 | | 9/2003 | Berman et al. | |
| 6,692,003 | B2 | * | 2/2004 | Potter et al. | 273/274 |
| 6,702,670 | B2 | * | 3/2004 | Jasper et al. | 463/20 |
| 6,769,986 | B2 | | 8/2004 | Vancura | |
| 6,843,724 | B2 | | 1/2005 | Walker et al. | 463/25 |
| 6,918,834 | B2 | | 7/2005 | Vancura | |
| 7,267,614 | B1 | * | 9/2007 | Jorasch et al. | 463/25 |
| 7,775,872 | B2 | * | 8/2010 | Bleich et al. | 463/20 |
| 2001/0024971 | A1 | * | 9/2001 | Brossard | 463/30 |
| 2001/0048193 | A1 | * | 12/2001 | Yoseloff et al. | 273/138.1 |
| 2002/0010018 | A1 | * | 1/2002 | Lemay et al. | 463/20 |
| 2002/0025847 | A1 | * | 2/2002 | Thomas et al. | 463/20 |
| 2002/0036380 | A1 | * | 3/2002 | Perrie et al. | 273/146 |
| 2002/0039919 | A1 | * | 4/2002 | Joshi et al. | 463/20 |
| 2002/0042300 | A2 | * | 4/2002 | Acres | 463/42 |
| 2002/0077178 | A1 | * | 6/2002 | Oberberger et al. | 463/42 |
| 2002/0111210 | A1 | * | 8/2002 | Luciano et al. | 463/29 |
| 2002/0128057 | A1 | * | 9/2002 | Walker et al. | 463/20 |
| 2002/0161645 | A1 | * | 10/2002 | Walker et al. | 705/14 |
| 2002/0169021 | A1 | * | 11/2002 | Urie et al. | 463/25 |
| 2002/0177479 | A1 | * | 11/2002 | Walker et al. | 463/25 |
| 2002/0193162 | A1 | * | 12/2002 | Walker et al. | 463/42 |
| 2002/0196342 | A1 | * | 12/2002 | Walker et al. | 348/157 |
| 2003/0003983 | A1 | * | 1/2003 | Walker et al. | 463/16 |
| 2003/0032476 | A1 | * | 2/2003 | Walker et al. | 463/25 |
| 2003/0050111 | A1 | * | 3/2003 | Saffari | 463/25 |
| 2003/0083121 | A1 | * | 5/2003 | Cole et al. | 463/16 |
| 2003/0100361 | A1 | * | 5/2003 | Sharpless et al. | 463/25 |
| 2003/0104853 | A1 | * | 6/2003 | Tessmer et al. | 463/16 |
| 2003/0119579 | A1 | * | 6/2003 | Walker et al. | 463/20 |
| 2003/0125103 | A1 | * | 7/2003 | Tessmer et al. | 463/20 |
| 2003/0144052 | A1 | * | 7/2003 | Walker et al. | 463/20 |
| 2003/0199305 | A1 | * | 10/2003 | Mathis | 463/20 |
| 2003/0207706 | A1 | * | 11/2003 | Potter et al. | 463/16 |
| 2003/0228901 | A1 | * | 12/2003 | Walker et al. | 463/25 |
| 2003/0228904 | A1 | * | 12/2003 | Acres et al. | 463/26 |
| 2004/0014522 | A1 | * | 1/2004 | Walker et al. | 463/25 |
| 2004/0018874 | A1 | * | 1/2004 | Bonney et al. | 463/25 |
| 2004/0029630 | A1 | * | 2/2004 | Walker et al. | 463/17 |
| 2004/0072618 | A1 | * | 4/2004 | Bartholomew et al. | 463/42 |
| 2004/0092301 | A1 | * | 5/2004 | Williams | 463/16 |
| 2004/0110555 | A1 | * | 6/2004 | Devaull et al. | 463/20 |
| 2004/0116174 | A1 | * | 6/2004 | Baerlocher et al. | 463/16 |
| 2004/0166918 | A1 | * | 8/2004 | Walker et al. | 463/16 |
| 2004/0176157 | A1 | * | 9/2004 | Walker et al. | 463/16 |
| 2004/0214634 | A1 | * | 10/2004 | Fasbender et al. | 463/25 |
| 2004/0219969 | A1 | * | 11/2004 | Casey et al. | 463/20 |
| 2004/0242313 | A1 | * | 12/2004 | Munoz | 463/20 |
| 2004/0242319 | A1 | * | 12/2004 | Walker et al. | 463/25 |
| 2005/0148383 | A1 | * | 7/2005 | Mayeroff | 463/20 |
| 2005/0173863 | A1 | * | 8/2005 | Walker et al. | 273/292 |
| 2005/0192087 | A1 | * | 9/2005 | Friedman et al. | 463/25 |
| 2006/0068896 | A1 | * | 3/2006 | Lin | 463/25 |
| 2006/0094498 | A1 | * | 5/2006 | Jorasch et al. | 463/25 |
| 2006/0154722 | A1 | * | 7/2006 | Walker et al. | 463/25 |
| 2006/0160597 | A1 | * | 7/2006 | Wright | 463/16 |
| 2006/0211489 | A1 | * | 9/2006 | Walker et al. | 463/25 |
| 2006/0252501 | A1 | * | 11/2006 | Little et al. | 463/25 |
| 2006/0287072 | A1 | * | 12/2006 | Walker et al. | 463/25 |
| 2007/0049373 | A1 | * | 3/2007 | Saffari | 463/25 |

| | | | | |
|---|---|---|---|---|
| 2007/0111786 | A1 * | 5/2007 | Snow | 463/27 |
| 2007/0167208 | A1 * | 7/2007 | Acres | 463/16 |
| 2007/0275777 | A1 * | 11/2007 | Walker et al. | 463/16 |
| 2008/0076576 | A1 * | 3/2008 | Graham et al. | 463/42 |
| 2009/0253501 | A1 * | 10/2009 | LeBaron | 463/30 |

FOREIGN PATENT DOCUMENTS

| | | |
|---|---|---|
| GB | 2 153 572 | 8/1985 |
| GB | 2 161 008 A | 1/1986 |
| GB | 2 353 128 | 2/2001 |
| WO | WO 96/08295 | 3/1996 |
| WO | WO 98/19280 | 5/1998 |

OTHER PUBLICATIONS

Brewer, Kathleen Pearl, Cummings, Leslie E., "Gaming language: getting a handle on slots.", Cornell Hotel & Restaurant Administration Quarterly, Apr. 1995, Section: vol. 36, No. 2, p. 74, ISSN: 0010-8804.

Bros, Robert J., "No Grey Area: Selling a Site Twice is Illegal", Chicago Tribune, Dec. 2, 1995, Section: Home Guide, p. 15, Zone CN, Reality Q&A.

Rose, Bob, "New Ways for the House to Win", St. Louis Post-Dispatch, Oct. 3, 1996, Section: Get Out, p. 50.

Brochure: "Power Play Slots", (http //www softsite com/ultif), Jan. 1997.

Author Unknown; "Innovative Gaming Announces Nevada Approval of IGT Joint Venture Game-Bonus Streak", PR Newswire; May 14, 1997, Section: Financial News.

Poole, David, "Letter From Charlotte: Vegas Perfect for Racing", Las Vegas Review-Journal, Jun. 22, 1997, Section C, p. 2C.

"Shuffle Master Begins Immediate Rollout of Five Deck Frenzy and Introduces New Version of Let It Ride", PR Newswire, Jun. 30, 1997, Section: Financial News.

Review: "Five Deck Frenzy", by Shuffle Master. and IGT, (http // pitboss com/R-5deck shtm), download date: Feb. 1, 1998.

Cook, Melissa, "The Best New Slots", Casino Player Magazine, Apr. 1998, p. 45.

Grochowski, John; "Royal Is Worth Taking a Risk" Chicago Sun Times, Apr. 5, 1998, Section: SHO, CASINOS, p. 18; NC.

Green, Marian; "The New Slot Market", International Gaming & Wagering Business, May 1998, vol. 19, No. 5.

Website: "World of Slots—The Game King", Casino Journal, (http:// www.casinocenter.com/journal/oct97/html/igt.html), download date Jun. 4, 1998.

Website: "A New Generation", Casino Journal (http://www. casinocenter.com/journal/oct97/html/bally html), download date Jun. 4, 1998.

Author Unknown; "The Interactive Experience", Casino Journal (http://www.casinocenter.com/journal/oct97/html/ac_coin.html), download date Jun. 4, 1998.

Brokopp, John, "New Slots Send Up Caution Flag", (http //brokopp casinocitytimes com/articles/545 html), dated: Aug. 2, 1999.

Brochure: "Vision Series—5-Line Double Diamond Mine", IGT, Copyright 2000.

Website: "Double Diamond Mine Slots", (http //www igt com/ GamingGroup/Games/gameasp?pid=5.12.108.119&theme_ id=2390), download date: Feb. 9, 2004.

Legato, Frank, "When a Bonus . . . Isn't", Strictly Slots, (http //www strictlyslots com/archive/0006ss/html/behind html), download date: Feb. 9, 2004.

Website: "Wild Wizard Slots", Gameport.com, (http //www gameport com/pcgames/cards/000075 html), download date: Feb. 9, 2004.

Website: "Williams X—Factor—3 Coin Dotmation", (http //www slotdepot com/723 htm), download date: Feb. 9, 2004.

Website: "Bell-Fruit Games—Happy Fruits AWP", (http //www bellfruitgames com uk/briefs/AWP/awp_happyfruits htm), download date: May 31, 2005.

Sprigg, Sean M. "USPTO Office Action", mailed Jun. 8, 2006, for U.S. Appl. No. 10/414,511, 10pp.

* cited by examiner

500

| RANDOM NUMBER 505 | OUTCOME 510 |
|---|---|
| 0 TO 10 | BAR, BAR, BAR |
| 11 TO 1,000 | CHERRY, CHERRY, CHERRY |
| 1,001 TO 1,000,000 | ANY, ANY, ANY |

FIG. 5A

PRIOR ART

550

| RANDOM NUMBER 555 | OUTCOME 560 |
|---|---|
| 0 TO 100 | 1ST WINNING OUTCOME |
| 101 TO 1,000 | 2ND WINNING OUTCOME |
| 1,001 TO 10,000 | 3RD WINNING OUTCOME |
| 10,001 TO 100,000 | 4TH WINNING OUTCOME |

FIG. 5B

600

| OUTCOME 605 | PAYOUT 610 |
|---|---|
| BAR, BAR, BAR | 100 |
| CHERRY, CHERRY, CHERRY | 10 |
| ANY, ANY, ANY | 0 |

FIG. 6A

PRIOR ART

650

| OUTCOME 655 | BONUS 660 |
|---|---|
| 1ST WINNING OUTCOME | 100 CREDITS + 2 FREE GAME PLAYS OF BASE GAME |
| 2ND WINNING OUTCOME | 100 CREDITS |
| 3RD WINNING OUTCOME | 10 CREDITS |
| 4TH WINNING OUTCOME | 5 CREDITS |

FIG. 6B

700

| PARAMETER TYPE 705 | PARAMETER VALUES 710 | PARAMETER VALUES PROBABILITIES 715 | CURRENT VALUE 720 |
|---|---|---|---|
| CARROTS | 8 | 10% | 12 |
| | 10 | 40% | |
| | 12 | 40% | |
| | 15 | 10% | |
| RABBITS | 2 | 25% | 6 |
| | 4 | 50% | |
| | 6 | 25% | |

FIG. 7

METHOD AND APPARATUS FOR FACILITATING ENTRY INTO BONUS ROUNDS

CLAIMING OF PRIORITY

This application claims the benefit of U.S. Provisional Application Ser. No. 60/581,539, filed Jun. 21, 2004 in the name of Walker et al. and entitled METHOD AND APPARATUS FOR PROVIDING ENTRY INTO BONUS ROUNDS. The entirety of this application is incorporated by reference herein for all purposes.

This application is a continuation-in-part of commonly-owned, co-pending U.S. application Ser. No. 10/784,845, filed Feb. 2, 2004 in the name of Walker et al. and entitled METHOD AND APPARATUS FOR SETTING GAME PARAMETERS, which application claims the benefit of U.S. Provisional Patent Application Ser. No. 60/449,270, filed Feb. 21, 2003, entitled "METHOD AND APPARATUS FOR SETTING GAME PARAMETERS." The entire content of each of these applications is incorporated herein by reference for all purposes.

CROSS-REFERENCE TO RELATED APPLICATIONS

The following patent applications also include subject matter that is related to the present application: U.S. patent application Ser. No. 10/778,576, filed Feb. 13, 2004, entitled "METHOD AND APPARATUS FOR ENHANCED PLAY OF A GAMING DEVICE"; which is a continuation-in-part of U.S. patent application Ser. No. 10/772,837, filed Feb. 5, 2004, entitled "ELECTRONIC AMUSEMENT DEVICE AND METHOD FOR ENHANCED SLOT MACHINE PLAY"; and also a continuation-in-part of U.S. patent application Ser. No. 09/716,918, filed Nov. 20, 2000, entitled "ELECTRONIC AMUSEMENT DEVICE AND METHOD FOR ENHANCED SLOT MACHINE PLAY"; which is a continuation of U.S. patent application Ser. No. 09/164,473, filed Oct. 1, 1998, entitled "ELECTRONIC AMUSEMENT DEVICE AND METHOD FOR ENHANCED SLOT MACHINE PLAY", which issued as U.S. Pat. No. 6,203,430 B1 on Mar. 20, 2001.

The present application is also related to subject matter contained in U.S. patent application Ser. No. 10/752,068, filed Jan. 6, 2004, entitled "ELECTRONIC AMUSEMENT DEVICE OFFERING SECONDARY GAME OF CHANCE AND METHOD FOR OPERATING SAME", which is a continuation of U.S. patent application Ser. No. 10/029,143, filed Dec. 27, 2001, entitled "ELECTRONIC AMUSEMENT DEVICE OFFERING SECONDARY GAME OF CHANCE AND METHOD FOR OPERATING SAME", which issued as U.S. Pat. No. 6,692,353 B2 on Feb. 17, 2004; and which is a continuation of U.S. patent application Ser. No. 09/108,646, filed Jul. 1, 1998, entitled "ELECTRONIC AMUSEMENT DEVICE OFFERING SECONDARY GAME OF CHANCE AND METHOD FOR OPERATING SAME", which issued as U.S. Pat. No. 6,364,765 B1 on Apr. 2, 2002.

The present application is also related to subject matter contained in U.S. patent application Ser. No. 10/361,201, filed Feb. 7, 2003, entitled "A GAMING DEVICE AND METHOD OF OPERATION THEREOF"; which is a continuation-in-part of U.S. patent application Ser. No. 09/521,875, filed Mar. 8, 2000, entitled "A GAMING DEVICE AND METHOD OF OPERATION THEREOF", which issued as U.S. Pat. No. 6,520,856 B1 on Feb. 18, 2003; which is a continuation of U.S. patent application Ser. No. 09/052,291, filed Mar. 31, 1998; entitled "A GAMING DEVICE AND METHOD OF OPERATION THEREOF", which issued as U.S. Pat. No. 6,068,552 on May 30, 2000.

The entire content of each of the above-referenced patents/applications is incorporated herein by reference for all purposes.

BRIEF DESCRIPTION OF THE DRAWINGS

FIG. 5A is a table illustrating an example data structure of a prior art probability database for use in some embodiments.

FIG. 5B is a table illustrating an example data structure of a bonus round probability database for use in some embodiments.

FIG. 6A is a table illustrating an example data structure of a prior art payout database for use in some embodiments.

FIG. 6B is a table illustrating an example data structure of a bonus round payout database for use in some embodiments.

FIG. 7 is a table illustrating an example data structure of a parameter value database for use in some embodiments.

DETAILED DESCRIPTION

Figure 1:
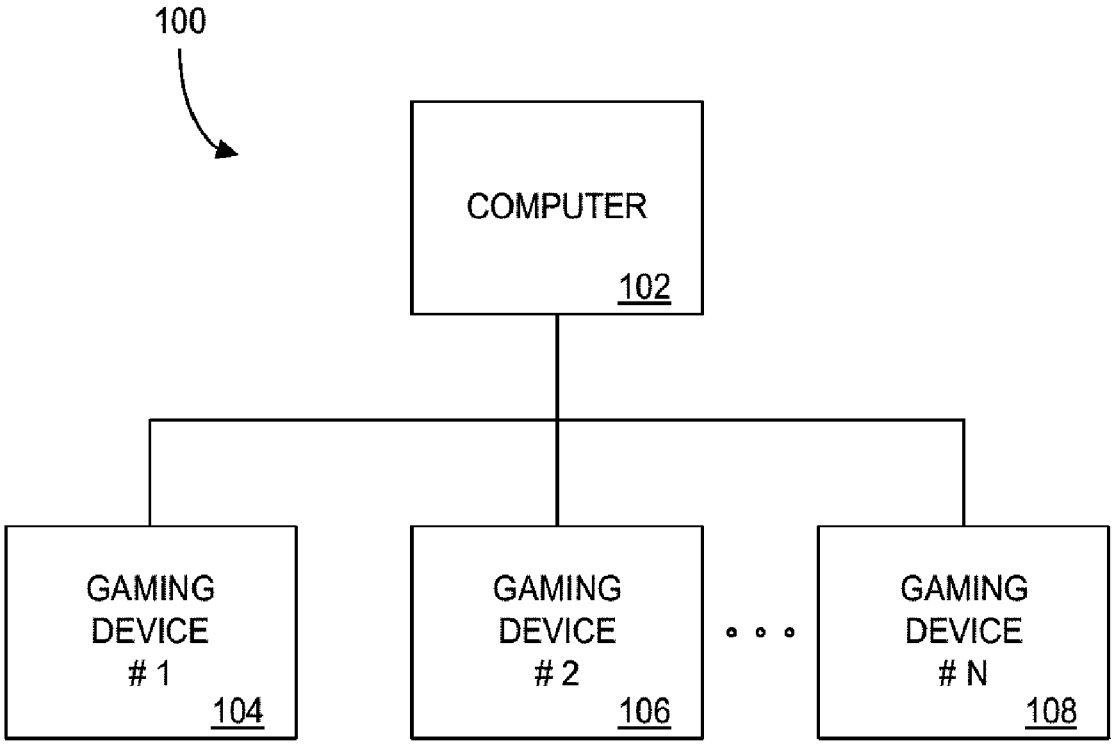
FIG. 1 is a block diagram illustrating an example system according to some embodiments.

As a preliminary matter, various terms and concepts used herein are described. Throughout the description that follows and unless otherwise specified, the following terms may include and/or encompass the example meanings provided in this section. These terms and illustrative example meanings are provided to clarify the language selected to describe embodiments both in the specification and in the appended claims.

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. Those skilled in the art will recognize that the disclosed invention(s) may be practiced with various modifications and alterations. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Neither the Title (set forth at the beginning of the first page of this patent application) nor the Abstract (set forth at the end of this patent application) is to be taken as limiting in any way as the scope of the disclosed invention(s).

The terms "an embodiment", "embodiment", "embodiments", "the embodiment", "the embodiments", "one or more embodiments", "some embodiments", "one embodiment" and the like mean "one or more (but not all) embodiments of the disclosed invention(s)", unless expressly specified otherwise.

The terms "including", "comprising" and variations thereof mean "including but not limited to", unless expressly specified otherwise.

The enumerated listing of items (which may or may not be numbered) does not imply that any or all of the items are mutually exclusive, unless expressly specified otherwise. Likewise, the enumerated listing of items (which may or may not be numbered) does not imply that the items are comprehensive of any category, unless expressly specified otherwise.

The terms "a", "an" and "the" mean "one or more", unless expressly specified otherwise.

The terms "plurality" mean "two or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention(s).

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

Each process/method includes one or more steps, and therefore a reference to a "step" of a method has an inherent antecedent basis.

It will be readily apparent that the various methods and algorithms described herein may be implemented by, e.g., appropriately programmed general purpose computers and computing devices. Typically a processor (e.g., a microprocessor) will receive instructions from a memory or like device, and execute those instructions, thereby performing a process defined by those instructions. Further, programs that implement such methods and algorithms may be stored and transmitted using a variety of known media in a number of well-known manners. In some embodiments, hard-wired circuitry or custom hardware may be used in place of, or in combination with, software instructions for implementation of the processes of the present invention. Thus, embodiments are not limited to any specific combination of hardware and software When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments need not include the device itself.

The term "computer-readable medium" as used herein refers to any medium that participates in providing data (e.g., instructions) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer-readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth, TDMA, CDMA, 3G.

Where databases are described, it will be understood by one of ordinary skill in the art that (i) alternative database structures to those described may be readily employed, and (ii) other memory structures besides databases may be readily employed.

The terms "basic game", "base game" and "primary game" are used interchangeably herein and may refer to an initial game or a main game facilitated by a gaming device, which may support a secondary game (e.g., a bonus game). The terms "basic game", "base game" and "primary game" may also refer to play resulting from the spinning of standard physical or graphical slot reels, the dealing of physical or electronic cards, or other game outcomes. The outcome of a basic game might be, for example, cherry-cherry-bar in a base game on a three-reel slot machine, 4 hits on a 7-spot keno ticket, or the hand Ks (king of spades), Qd (queen of diamonds), 4h (four of hearts), 2s (two of spades), 6s (six of spades) in a base game of video poker.

The term "secondary game" may refer to a game that is related to or supported by the base game. It should be noted that "supported by" does not mean that the secondary game can only be, or a round thereof necessarily is, accessed in response to an outcome or other event being achieved in the base game. Rather, a secondary game being supported by or related to a base game may mean that the base game provides a basis for the existence of the secondary game. For example, the secondary game may be thematically related to the base game and/or an outcome of the secondary game may affect a status of the base game and vice versa. It should be noted that while a base game may exist without a secondary game, a secondary game typically cannot exist without a base game.

The term "bonus game" may refer to particular type of secondary game, such as a feature or aspect of the base game that may be considered distinct or separable from the base game, wherein aspects of the bonus game may somehow be interrelated to the base game and may be supported by the base game. Further, a bonus game is an aspect or feature of the base game for which (i) only winning results may be achieved and/or (ii) a greater frequency of winning results and/or larger possible payouts is provided than is provided for the supporting base game. The meaning of "supported by" for purposes of this term is the same as for purposes of the term "secondary game", as defined immediately above.

For example, a theme of a bonus game may be interrelated with a theme of the base game. In another example, a bonus game may be a feature of a base game that, prior to embodiments described herein, could only be entered based on an occurrence of an event in the base game (e.g., an outcome of the base game would trigger entry into the bonus game). In another example, an event in a bonus game may cause an advance or result in a base game or vice versa.

Prior to embodiments described herein, a bonus game may have been defined as an aspect of the base game for which no additional consideration is required. However, in embodiments described herein, a player may be allowed to provide a payment in exchange for an entry into a bonus game (e.g., in lieu of having to wait to win an entry into the bonus game). In some embodiments, a bonus game may produce only "winning" results, even if an amount of winnings for a bonus round is less than a payment amount for the bonus round. In one embodiment, a bonus game may correspond to (i) a different or modified probability table than is used for the base game and/or (ii) a different or modified payout table than used for the base game. For example, in one embodiment of a bonus game, all possible outcomes may correspond to a payout. In some embodiments of the present invention, a player may specify a type of game play to be purchased (e.g., a game play of a base game or bonus round of a bonus game).

The term "game", unless specified otherwise, may refer to a wagering activity whereby a player posts consideration, usually monetary in form, in exchange for a chance at winning a payout (which is typically a monetary payout). The definition is intended to include basic or primary games and bonus or secondary games.

The term "game play" may refer to a single play of a base game or a secondary game at a gaming device that generates a singular, corresponding outcome (e.g., a player pulls the handle of a slot machine and the reels resolve to "Bar-Bar-Bar"). In one embodiment, a player wagers a number of credits in accordance with each game play. In some embodiments, one or more game plays may be associated with a particular cashless gaming receipt. For example, (i) the wagered credits of a game play may be derived from a balance of credits generated by an inserted receipt, or (ii) a game play may occur during a session initiated by a receipt. In a video poker embodiment, a game play may result in a first and second hands, both in the same game.

The term "bonus round" may refer to a single play of a bonus game at a gaming device that generates a singular, corresponding outcome (e.g., a random number is determined and a video displayed to output the result corresponding to the random number, such as to indicate how many credits the player has won as a result of the random number) or a single attempt via a bonus game to win a prize. In one embodiment, a player provides a payment in exchange for an entry into a bonus round of a bonus game.

The term "game play parameter" may refer to a variable whose value governs aspects of play at the gaming device, exclusive of variables directly related to payout amounts, pay table selection, and payout probabilities. In one embodiment, the value of a game play parameter may be determined by a random selection process. Examples of game play parameters include a balance of a credit meter, a number of handle pulls for which a bonus mode will remain active, a probability of a game character appearing on a given handle pull, a required wager amount per handle pull, and an initial number of cards a player is dealt in a poker game.

The term "game parameter" may refer to a variable whose value governs play at the gaming device and is determined by a random selection process. Game parameters include game play parameters. Examples of game parameters include a payout for bar-bar-bar, a number of cherry symbols on the first reel, and a probability of a game character finding hidden treasure.

The term "game parameter value" may refer to a value associated with a game parameter, such as 200 coins, 12 cherry symbols, or a 30% chance of finding treasure.

The term "game play parameter value" may refer to a value associated with a game play parameter, such as a 100 credits credit meter balance.

The term "game play parameter value indicia" and "game play parameter value symbol" may refer to one or more indicia (e.g., one or more reel symbols) that represents a game play parameter value, such as a reel symbol displaying "200 coins" or "12 cherry symbols" or a card in a card game that bears the indicia "30 credits." The indicia or symbol could also be found on other representations of random events such as spinners, which could be located on a secondary screen.

The terms "controller" and "computer" shall be synonymous and may refer to an electronic device (e.g., a personal computer) that communicates with one or more gaming devices. In a manner well known in the art, a controller may function as a computer server and may control the actions of gaming devices. A controller may also contain databases to record statistics such as coin-in, coin-out, jackpot information, theoretical wins, etc.

The terms "game", "session" and "play session" are used interchangeably herein and may refer to a gambling event with a beginning and end that may encompass a number of game plays, spins, handle pulls, or span of time. The end of the game may be determined voluntarily (in which the player elects to stop play) or involuntarily (in which the gaming device terminates play). In some embodiments, a game session may be associated with a particular cashless gaming receipt, particular player or particular player identifier and/or particular gaming device. For example, an associated session may begin when a player inserts a particular cashless gaming receipt, and end when the player cashes out.

The terms "cash-out ticket", "cashless gaming ticket", "ticket", and "cashless gaming receipt" are used interchangeably herein and may refer, unless specified otherwise, to a substrate (e.g., a small piece of paper) that may be output and/or received by a device such as a gaming device (e.g., via a "ticket-in/ticket-out" slot of a gaming device or its peripheral device) and that is redeemable for cash or another benefit and/or may be used for wagering purposes. A cash-out ticket may be issued by a game or gaming device, or as a result of a communication from a game or gaming device to associated equipment. A cash-out ticket may be associated with a value that is based on a credit meter balance of a gaming device at the time a player requests to cash out the balance and is issued the cash-out ticket. A cash-out ticket may comprise (i) machine-readable indicia (e.g., a bar code) or other machine-readable substance (e.g., magnetically encoded material) and/or (ii) an identifier (e.g., a unique series of numeric digits or alphanumeric characters). In one or more embodiments, machine-readable indicia may indicate an identifier (e.g., a printed barcode encodes a ticket identifier). In one embodiment, a database stored at a central location (e.g., a server operable to communicate with one or more gaming device, one or more casino attendant terminals and/or other devices)

may store records of issued cash-out tickets, each record correlating an identifier of a cash-out ticket to a value. A cash-out ticket may entitle its bearer (or a specified person) to an amount of credits or currency equal to an indicated face value or to an amount based on an indicated face value. An indicated face value may correspond to an amount of credits indicated by a credit meter balance of a gaming device at the time of cash-out.

The term "outcome" may refer, unless specified otherwise, to a result of a game play or bonus round and may refer to one or more indicia indicative of the result. Examples of outcomes include cherry-cherry-cherry in a slot machine game, a push in blackjack, a flush in video poker, the completion of a puzzle, the attainment of a goal, etc. Different types of gaming devices may have widely varying types of outcomes. Several are described in detail herein and still others will be apparent to those of skill in the art based on the present disclosure.

The term "payout" may refer, unless specified otherwise, to a prize, reward, winnings, or bonus to be provided as a result of an outcome that corresponds to the payout. For example, a payout may comprise an amount of currency. For example, an amount of cash, electronic credits, and/or comp points may be provided as a result of an outcome that corresponds to the payout.

The term "jackpot" may refer, unless specified otherwise, to the top prize, or value of greatest relative benefit, available for winning via a game.

The term "game character" may refer to a character, which may be a cartoon and/or digitally generated or a video taped rendition of a celebrity, which is involved in the game playing experience. The character may entertain the player, explain payouts, try to steal objects from the player, try to defend objects held by the player, and the like. The character could be a life-like animation of a television character, or even just the audio associated with a well-known character.

The term "gaming device" may refer to any electrical, mechanical, or electro-mechanical device that, in a manner well known in the art, accepts wagers, steps through a process to determine an outcome, and pays winnings based on the outcome. The outcome may be randomly generated, as with a slot machine; may be generated through a combination of randomness and player skill, as with video poker; or may be generated entirely through player skill. Gaming devices may include slot machines (both video and mechanical reels), video poker machines, video blackjack machines, video roulette machines, video keno machines, video bingo machines, pachinko machines, video lottery terminals, handheld gaming devices, and the like.

The term "peripheral device" may refer to a device operatively connected to a gaming device that is configured to assist in the operation of game-related functions. In some embodiments peripheral devices may be located near players at a table game.

The term "player tracking card" may refer to a casino issued plastic or paper card (resembling a frequent shopper card) given to players as a way of identifying the player at a slot machine or table game. As is well known in the art, such cards typically have encoded thereon (in machine-readable and/or human readable form) a player identifier (e.g., a six digit number) which uniquely identifies the player (e.g., because the number is associated with a record in a database that includes corresponding player information). At a slot machine, the player inserts the card into a reader device and the player identifier is read from the card, most often magnetically. From the player identifier which the reader device reads, the corresponding player information may in turn be read from the database, typically via a network connection between the reader device and a device hosting the database.

The term "prepaid session" may refer to a quantity of time or handle pulls that are paid for in advance. Once a session is prepaid, the player does not need to supply any additional funds until the session has been completed. A prepaid session may allow the player to complete many games during the session.

The term "primary game screen" may refer to a screen used to display game information such as a video representation of one or more spinning reels.

The term "secondary game screen" may refer to a screen used to display secondary game information such as the animation and graphics associated with a bonus round. In one embodiment, the primary game screen and the secondary game screen are the same game screen.

The terms "credit balance", as used herein unless specified otherwise, may refer to an indication of an amount of currency (or other value) that is due to a player and/or that is available for wagering (e.g., a wager may be drawn from a credit balance). In some embodiments, a balance may be associated with a gaming device being operated by a player. An indication of the amount of currency or other value may be output via a gaming device display, such as an LED "credit meter." In some embodiments, a player wishing to cash out is provided with payment (e.g., a cashless gaming ticket) equal to his credit balance, or otherwise based on his credit balance (e.g., the integer amount of a credit balance, such as $5.00 for a balance of $5.50). In another embodiment, a credit balance may be stored on a smart card and/or a casino server (e.g., and available for transfer to a gaming device).

The terms "initial credit meter balance" may refer to a balance of the credit meter established prior to commencing a game play of a base game for a particular play session.

Turning now to a description of the embodiments, at least one embodiment allows a gaming device to set or modify game parameters through the use of random events such as spinning slot machine reels. In some embodiments, game parameters may be established with various initial values, and then, by spinning the gaming devices' reels, for example, random reel values lining up on the payline may be used as new game parameter values. Parameter values may be used to control almost any aspect of the gaming device play experience, ranging from the types of symbols seen on the reels to the rate at which "complementary" points are awarded.

One example of a game play parameter is a balance of a credit meter. In accordance with one embodiment, a random event (e.g., a result of a bonus round, determined based on a random number) may be used to set a value for the game play parameter comprising the balance of the credit meter. This may be done in lieu of establishing a balance of the credit meter that corresponds to an amount of funds input into the gaming device by a player. In other words, in one embodiment the amount of credits added to a credit meter is based on a random result of one or more bonus rounds rather than the amount of credits directly corresponding to an amount of funds provided by the player. In one embodiment, a player may provide an amount of funds as payment for entry into a bonus round.

In accordance with one embodiment, a player may obtain one or more bonus rounds immediately upon commencing play at a gaming device (e.g., by providing payment in exchange for the entry into the bonus round). This may be an option available to a player of a gaming device, which the player may exercise instead of waiting to qualify for entry into the bonus round based on an event in the primary game.

As described, in accordance with one embodiment, a result of a bonus round may serve to establish an initial balance of credits for a player. Once the initial balance of credits has been established, the player may play the gaming device in standard fashion using the credits of the credit meter balance to make wagers.

In one embodiment, a player may provide a payment to alter a parameter of a bonus round in addition to or in lieu of paying for an entry into a bonus round. For example, a player may provide a payment to access a more favorable payout table for a bonus round and/or a more favorable probability table for a bonus round than would otherwise be utilized.

Various examples of some embodiments are provided below. These examples are provided for illustrative purposes only and should not be construed as limiting in any manner.

With these and other advantages and features of the invention that will become hereinafter apparent, the nature of the invention may be more clearly understood by reference to the following detailed description of the invention, the appended claims and to the several drawings included herein.

In the following description, reference is made to the accompanying drawings that form a part hereof, and in which is shown, by way of illustration, specific embodiments in which the invention may be practiced. These embodiments are described in sufficient detail to enable those skilled in the art to practice the invention, and it is to be understood that other embodiments may be utilized and that structural, logical, software, hardware, and electrical changes may be made without departing from the scope of the present invention. The following description is, therefore, not to be taken in a limited sense, and the scope of the present invention is defined by the appended claims.

Systems and Apparatus

An example embodiment of the system 100 of the present invention is depicted in FIG. 1. The present invention can be configured to work as a system 100 in a network environment including a computer 102 (e.g., a slot server of a casino) that is in communication, via a communications network, with one or more gaming devices 104, 106, 108 (e.g., slot machines, video poker machines). The computer 102 may communicate with the gaming devices directly or indirectly, via a wired or wireless medium such as the Internet, LAN, WAN or Ethernet, Token Ring, or via any appropriate communications means or combination of communications means. Each of the gaming devices 104, 106, 108 may comprise computers, such as those based on the Intel® Pentium® processor, that are adapted to communicate with the computer 102. Any number and type of devices 104, 106, 108 may be in communication with the computer 102.

Communication between the devices 104, 106, 108 and the computer 102, and among the devices 104, 106, 108, may be direct or indirect, such as over the Internet through a Web site maintained by computer on a remote server or over an on-line data network including commercial on-line service providers, bulletin board systems and the like. In yet other embodiments, the devices 104, 106, 108 may communicate with one another and/or the computer 102 over RF, cable TV, satellite links and the like.

Some, but not all, possible communication networks that may comprise the network or be otherwise part of the system 100 include: a local area network (LAN), a wide area network (WAN), the Internet, a telephone line, a cable line, a radio channel, an optical communications line, and a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

A variety of communications protocols may be part of the system 100 or another system described herein (e.g. system 200, described with respect to FIG. 2), including but not limited to: Ethernet (or IEEE 802.3), SAP, SAS™, Super-SAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Communication may be encrypted to ensure privacy and prevent fraud in any of a variety of ways well known in the art.

In some embodiments, a server computer 102 may not be necessary and/or preferred. For example, the present invention may, in one or more embodiments, be practiced on a stand-alone gaming device 104 and/or a gaming device 104 in communication only with one or more other gaming devices 106, 108 (i.e. with a computer server 102). In such embodiments, any functions described as performed by the computer 102 or data described as stored on the computer 102 may instead be performed by or stored on one or more gaming devices 104, 106, 108.

Figure 2:
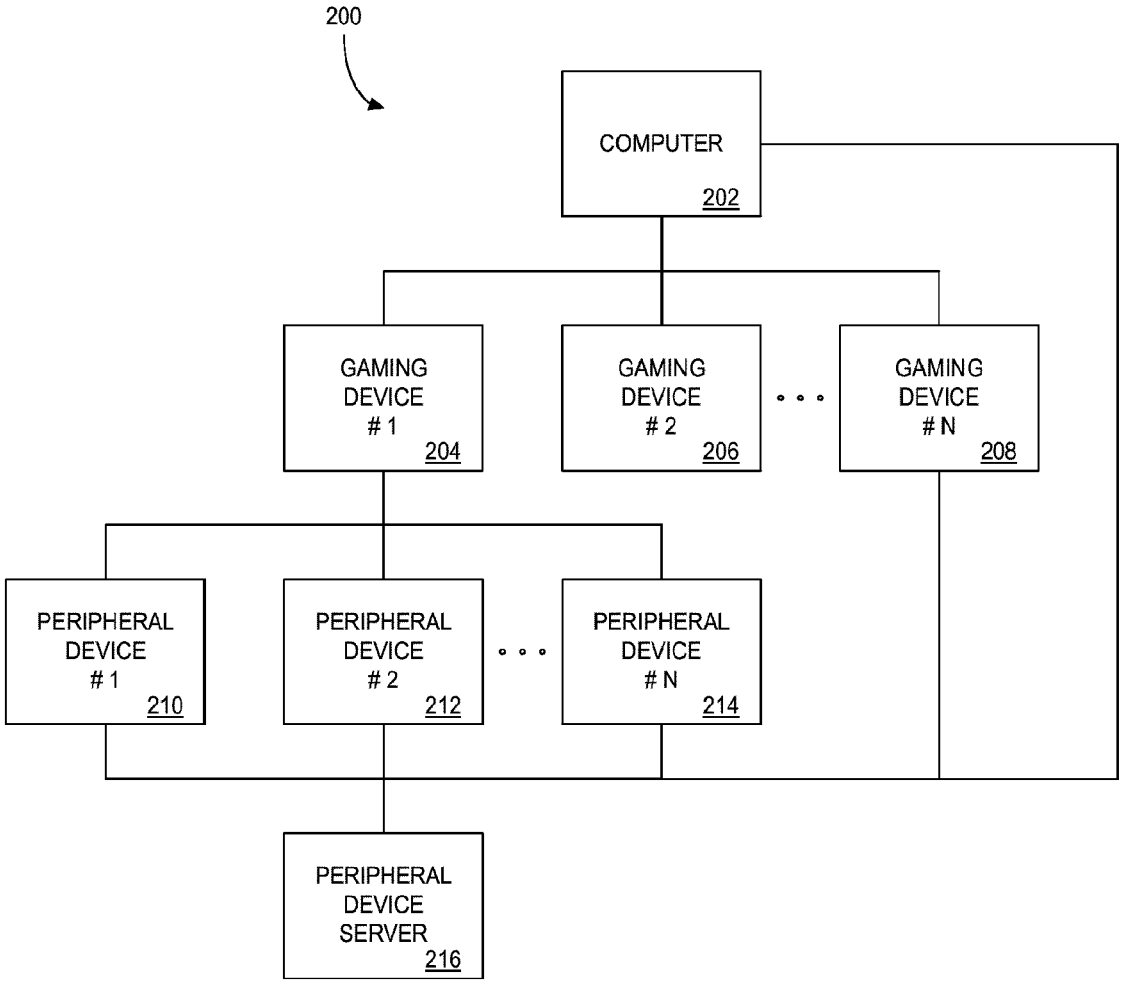
FIG. 2 is a diagram illustrating an example alternative system according to some embodiments.

Turning to FIG. 2, an alternative system 200 according to some embodiments of the present invention includes a computer 202 (e.g., a slot server of a casino) that is in communication, via a communications network, with one or more gaming devices 204, 206, 208 (e.g., slot machines, video poker machines). A difference between the aforementioned system 100 and this alternative system 200 is that in this system 200 at least one gaming device 204 is also in communication with one or more peripheral devices 210, 212, 214. A peripheral device 210, 212, 214 may, in turn, be in communication with a peripheral device server 216 and, in some embodiments, with the computer 202. In some embodiments the peripheral device server 216 may be in communication with one or more gaming devices 204, 206, 208 and/or the computer 216.

The computer 202 may communicate with the devices 204, 206, 208 and peripherals 210, 212, 214 directly or indirectly, via a wired or wireless medium such as the Internet, LAN, WAN or Ethernet, Token Ring, or via any appropriate communications means or combination of communications means. For example, the computer 202 may communicate directly with one of the gaming devices 204, 206, 208 (e.g., via a LAN) and indirectly (e.g., via a gaming device) with a peripheral device 210, 212, 214. In another example, the computer 202 may communicate with one of the gaming devices 204 via a LAN and with another of the gaming devices 208 via the Internet (e.g., if the particular gaming device 208 comprises a personal computer in communication with an online casino).

Each of the devices 202, 204, 206, 208, 210, 212, 214, 216 of the system 200 may comprise computers, such as those based on the Intel® Pentium® processor, that are adapted to communicate with the computer. Further, each of the devices 202, 204, 206, 208, 210, 212, 214, 216 may comprise a gaming device such as a mechanical or electronic slot machine, a video poker machine, a video blackjack machine, a video keno machine, a pachinko machine, a video roulette machine, and/or a lottery terminal. Further yet, each of the devices 202, 204, 206, 208, 210, 212, 214, 216 may comprise an external or internal module associated with one or more of the gaming devices 204, 206, 208 that is capable of communicating with one or more of the gaming devices 204, 206, 208 and of directing the one or more gaming devices 204, 206, 208 to perform one or more functions. Any number of devices 204, 206, 208, 210, 212, 214, 216 may be in communication with the computer 202. Any number and type of peripheral devices 210, 212, 214 may be in communication with a gaming device 204, peripheral device server 216 and the computer 202.

Communication between the devices 204, 206, 208, 210, 212, 214 and the computer 202, between each of the devices 204, 206, 208, 210, 212, 214, between the peripheral device server 216 and the devices 204, 206, 208, 210, 212, 214, and between the peripheral device server 216 and the computer 202, may be direct or indirect, such as over the Internet through a Web site maintained by the computer 202 on a remote server or over an on-line data network including commercial on-line service providers, bulletin board systems and the like. In yet other embodiments, any and all of the devices 202, 204, 206, 208, 210, 212, 214, 216 of the system 200 (i.e., the devices 204, 206, 208, 210, 212, 214, the computer 202, and the peripheral device server 216) may communicate with one another over RF, cable TV, satellite links and the like.

Some, but not all, possible communication networks that may comprise the network or otherwise be part of the system include: a local area network (LAN), a wide area network (WAN), the Internet, a telephone line, a cable line, a radio channel, an optical communications line, a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

In some embodiments, the computer 202 may not be necessary and/or preferred. For example, the present invention may, in one or more embodiments, be practiced on a standalone gaming device 204, one or more gaming devices 204, 206, 208 in communication with one or more peripheral devices 210, 212, 214, one or more gaming devices 204, 206, 208 in communication with a peripheral device server 216, one or more peripheral devices 210, 212, 214 in communication with a peripheral device server 216, and/or a gaming device 208 in communication only with one or more other gaming devices 204, 206. In such embodiments, any functions described as performed by the computer 202 or data described as stored in a memory of the computer 202 may instead be performed by or stored on one or more gaming devices 204, 206, 208, one or more peripheral devices 210, 212, 214, and/or peripheral device server 216.

Similarly, a peripheral device server 216 may not be desired and/or needed in some embodiments of the present invention. In embodiments that do not involve a peripheral device server 216, any or all of the functions described herein as being performed by a peripheral device server 216 may instead be performed by another server computer, the computer 202, one or more gaming devices 204, 206, 208, one or more peripheral devices 210, 212, 214, or a combination thereof. Similarly, in embodiments that do not involve a peripheral device server 216 any data described herein as being stored in a memory of a peripheral device server 216 may instead be stored in a memory of another server computer, the computer 202, one or more gaming devices 204, 206, 208, one or more peripheral devices 210, 212, 214, or a combination thereof.

Any or all of the gaming devices 204, 206, 208 may, respectively, include or be in communication with a peripheral device 210. A peripheral device 210 may be a device that receives information from (and/or transmits information to) one or more gaming devices 204, 206, 208. For example, a peripheral device 210 may be operable to receive information about games being played on a gaming device 204, such as the initiation of a game and/or a random number that has been generated for a game.

In one or more embodiments, one or more such peripheral devices 210, 212, 214 may be in communication with a peripheral device server 216. This allows the peripheral device server 216 to receive information regarding a plurality of games being played on a plurality of gaming devices 204, 206, 208. The peripheral device server 216, in turn, may be in communication with the computer 202. It should be understood that any functions described herein as performed by a peripheral device 210 may also or instead be performed by the peripheral device server 216. Similarly, any data described herein as being stored on or accessed by a peripheral device 210 may also or instead be stored on or accessed by the peripheral device server 216.

A peripheral device 210 may be operable to access a database (e.g., of a peripheral device server 216) to provide benefits (e.g., cashless gaming receipts) based on, for example, an outcome of a bonus round.

The peripheral device server 216 may also monitor player gambling history over time by associating gambling behavior with player identifiers, such as player tracking card numbers. For example, information about the player obtained or accessed by a peripheral device server 216 may be analyzed, e.g., to identify those players that a particular gaming machine owner, operator, or manufacturer finds most desirable. Based upon desired objectives, the peripheral device server 216 may direct the appropriate peripheral device 210 to issue customized messages, offers, and games to specific players.

Information received by a peripheral device 210 from a gaming device 204 may include gambling data such as number of games initiated per unit of time, outcomes displayed for games initiated, payouts corresponding to outcomes displayed, a credit meter balance of the gaming device 204, and/or data associated with the player currently playing the gaming device 204.

The functions described herein as being performed by a peripheral device server 216 and/or a peripheral device 210 may, in one or more embodiments, be performed by the computer 202 (in lieu of or in conjunction with being performed by a peripheral device server 216 and/or a peripheral device 210).

In some embodiments, a peripheral device 210 may be useful for implementing the embodiments of the present invention into the operation of a conventional gaming device. For example, in order to avoid or minimize the necessity of modifying or replacing a program already stored in a memory of a conventional gaming device, an external or internal module that comprises a peripheral device 210 may be inserted in or associated with a conventional gaming device to transform it into a gaming device 204 of the present invention.

Thus, for example, a peripheral device 210 may be utilized to monitor play of the gaming device 204 and output messages and an outcome of a game. In such embodiments the gaming device 204 with which the peripheral device 210 is in communication may continue to operate conventionally. In such embodiments the gaming device 204 may continue to output an outcome for each game played. The peripheral device 210, however, may output an outcome or payout of a bonus round when appropriate. The peripheral device 210 may also output messages to the player. The peripheral device 210 may also provide benefits to a player (e.g., coins, tokens, electronic credits, paper receipts exchangeable for cash, services, and/or merchandise).

Accordingly, a peripheral device 210 may include (i) a communications port (e.g., for communicating with one or more gaming devices, peripheral device server, another peripheral device, and/or computer; (ii) a display (e.g., for displaying messages and/or outcomes and payouts), (iii) another output means (e.g., a speaker, light, or motion device to communicate with a player), and/or (iv) a benefit providing means (e.g., a printer and paper dispensing means, a credit meter, and/or a hopper and hopper controller).

In some embodiments, a peripheral device 210 may not output outcomes and/or messages to a player but may instead direct a processor of a gaming device 104/204 to perform such functions. For example, a program stored in a memory of peripheral device 210 may cause a processor 300 of a gaming device 104/204 to perform certain functions. For example, a program stored in a memory of peripheral device 210 may cause a processor 300 of a gaming device 104/204 to output an outcome, determine an outcome, output a message, access a database, provide a benefit, refrain from providing a benefit (e.g., by not sending a signal to a hopper controller of the gaming device when it otherwise normally would), and/or communicate with another device. Examples of peripheral devices 210, 212, 214 include (1) electronic apparatuses "retrofitted" to conventional gaming devices so that inventive processes disclosed herein may be realized through game play at the gaming device 104/204, (2) Personal Digital Assistants such as those manufactured by Palm, Inc., (3) lap top computers, (4) cellular telephones, (5) pagers, or (6) any combination thereof.

In one or more embodiments, either or both of system 100 and system 200 may include additional devices, such as one or more kiosks and/or one or more casino personnel devices. One or more point-of-sale terminals associated with one or more merchants may also be included in either or both of system 100 and system 200.

In some embodiments, a kiosk may be configured to execute or assist in the execution of various processes of the present invention. In some embodiments, a kiosk may comprise a processor and a memory as described. A kiosk may also comprise various input devices (e.g., a keypad, a keyboard, a mouse, buttons, a port that receives player tracking cards, an optical scanner for reading barcodes or other indicia, a CCD camera, etc.), output devices (e.g., a display screen, audio speakers, etc.), benefit output devices (e.g., a coin tray or printer for printing cashless gaming tickets), combinations thereof (e.g., a "ticket-in/ticket-out" device, a touch-sensitive display screen, etc.), communications ports, and so on. Thus, a kiosk may comprise many of the features and components of a gaming device, though the kiosk itself may not necessarily be configured to enable gambling activity as a primary function. A kiosk may communicate with any or all of (i) a central controller, (ii) a gaming device, (iii) an inventory/reservation system of a casino-maintained property (e.g., a hotel), (iv) casino personnel devices, (v) merchant POS terminals, and so on. A number of kiosks may be stationed within casino premises (e.g., at various locations on a slot floor). In various embodiments, kiosks may execute or assist in the execution of (i) determining and outputting a player status or other types of data described herein (e.g., a kiosk receives a player tracking card, and outputs a number of accumulated reward which a player may be entitled to redeem), (ii) outputting payments to players (e.g., upon receipt of cashless gaming tickets, player tracking cards, smart cards, etc.), and/or (iii) any other process described herein. Thus, such a device may be configured to read from and/or write to one or more databases of the present invention. The memory of such a device may store a program for executing such processes.

In some embodiments, various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a casino personnel device may communicate with a gaming device, server, kiosk, peripheral device, and/or an inventory/reservation system of a casino-maintained property (e.g., a hotel). Thus, a casino personnel device may be configurable to, among other things, (i) read from and/or write to one or more databases of the present invention, (ii) assist in payments made to players (e.g., a representative "scans" a cashless gaming receipt and determines a value associated with the receipt, and if the receipt is valid, provides payment equal to the value), and/or (iii) execute or assist in the execution of various other processes described herein. The memory of such a device may store a program for executing such processes.

In some embodiments, various merchants (e.g., shops, restaurants, etc.) may utilize point-of-sale (POS) computer terminals to facilitate various processes of the present invention. For example, in some embodiments, a player may receive a cashless gaming ticket redeemable for an amount of currency. However, the ticket may alternately or additionally be redeemable for an amount of credit at a particular merchant location. Thus, in some embodiments, merchants may utilize POS terminals to redeem such vouchers. In some embodiments, such devices may be configured to read from and/or write to one or more databases of the present invention. Such POS terminals may thus comprise various hardware and software described herein with respect to other devices, and may communicate with (i) a central slot server, (ii) a gaming device, (iii) an inventory/reservation system (e.g., a computer terminal at a theatre communicates with an inventory database to determine a number of unsold seats for a certain event), (iv) a kiosk, and so on.

In some embodiments of the present invention, various component devices (e.g., any or all of the benefit output devices, output devices, input devices and/or input output devices described herein) may be embodied as peripheral devices. For example, such devices may not necessarily be components of a gaming device, though they may be configured in such a manner so as to communicate with one or more gaming device processors or any other devices described herein. For example, a peripheral device such as a large display device may be associated with a plurality of gaming devices, and thus may not necessarily be considered a component of any one gaming device. Further, in some embodiments, certain peripheral devices such as card readers may be interchangeable between gaming devices, and thus may be considered a component of a first gaming device while connected thereto, removed from the first gaming device, connected to a second gaming device, and so on. In other embodiments, various peripheral devices may never be considered a component of a particular gaming device. For example, in some embodiments, a peripheral device such as a USB-based portable memory device may store (i) one or more databases described herein, and/or (ii) a program for executing one or more process steps described herein. Such a peripheral device may then be utilized by casino personnel for upgrading/retrofitting existing gaming devices as described herein.

Figure 3:
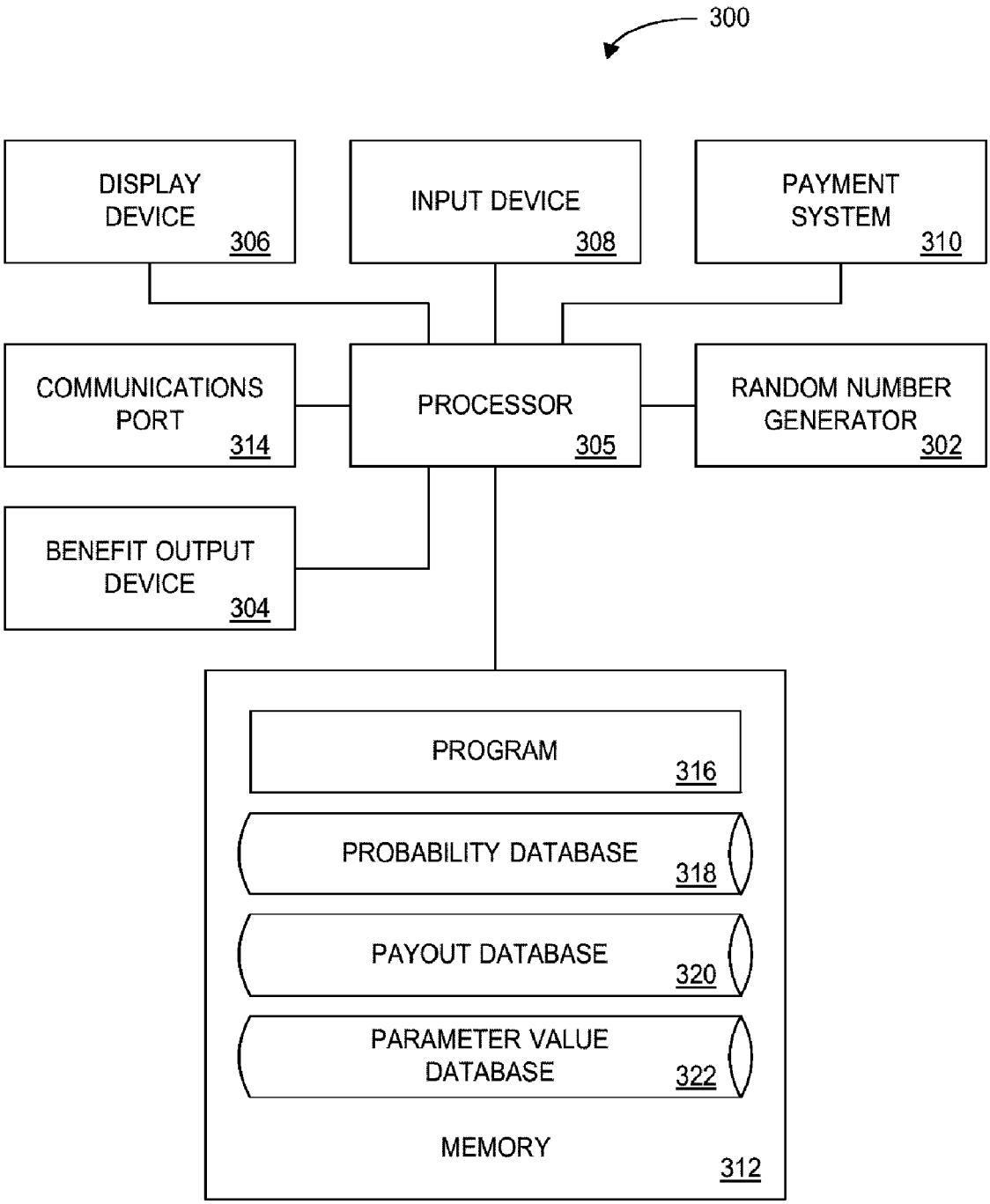
FIG. 3 is a block diagram illustrating an example gaming device according to some embodiments.

Turning to FIG. 3, illustrated therein is an embodiment 300 of an example gaming device. Embodiment 300 is referred to herein as gaming device 300. Gaming device 300 may comprise any or all of gaming device 104, gaming device 106, gaming device 108, gaming device 204, gaming device 206, and gaming device 208. Gaming device 300 may be implemented as a system controller, a dedicated hardware circuit, an appropriately programmed general-purpose computer, or any other equivalent electronic, mechanical or electro-mechanical device. As indicated above, the gaming device 300 may comprise, for example, a slot machine, a video poker machine, a video blackjack machine, a video keno machine, a video lottery machine, a pachinko machine or a table-top game. In various embodiments, a gaming device 300 may comprise, for example, a personal computer (e.g., which communicates with an online casino Web site), a telephone (e.g., to communicate with an automated sports book that provides gaming services), or a portable handheld gaming device (e.g., a personal digital assistant or Nintendo GameBoy®). The gaming device 300 may comprise any or all of the gaming devices of the aforementioned systems. In some embodiments, a user device such as a PDA or cell phone may be used in place of, or in addition to, some or all of the gaming device components. Further, a gaming device 300 may comprise a personal computer or other device operable to communicate with an online casino and facilitate game play at the online casino. In one or more embodiments, the gaming device 300 may comprise a computing device operable to execute software that simulates play of a reeled slot machine game, video poker game, video blackjack game, video keno game, video roulette game, or lottery game.

In some embodiments, a gaming device 300 may comprise a processor 305, such as one or more Intel® Pentium® processors. The processor 305 may be operable to communicate with a random number generator 302, which may be a component of the gaming device 104. The random number generator 302, in accordance with some embodiments of the present invention, may generate data representing random or pseudo-random values (referred to as "random numbers" herein). The random number generator 302 may generate a random number every predetermined unit of time (e.g., every thousandth of a second) or in response to an initiation of a game on the gaming device 300. In some embodiments, the generated random numbers may be used as they are generated (e.g., the random number generated at substantially the time of game initiation is used for that game) and/or stored for future use. A random number generated by the random number generator 302 may be used by the processor 305 to determine, for example, at least one of an outcome and payout. A random number generator 302, as used herein, may be embodied as a processor separate from but working in cooperation with the processor 305. Alternatively, the random number generator 302 may be embodied as an algorithm, program component, or software stored in the memory of the gaming device 104 and used to generate a random number.

Note that, although the generation or obtainment of a random number is described herein as involving a random number generator 302 of a gaming device 300, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof. In one embodiment, a computer 102 or computer 202 may generate or determine a random number and provide it to the gaming device 300 for use in determining an outcome.

The processor 305 may also be operable to communicate with a benefit output device 304, which may be a component of gaming device 300. The benefit output device 304 may comprise one or more devices for outputting a benefit to a player of the gaming device. For example, in some embodiments the gaming device 300 may provide coins and/or tokens as a benefit. In such embodiments, the benefit output device 304 may comprise a hopper and hopper controller, for dispensing coins and/or tokens into a coin tray of the gaming device. In another example, the gaming device 300 may provide a receipt or other document on which there is printed an indication of a benefit (e.g., a cashless gaming receipt that has printed thereon a monetary value, which is redeemable for cash in the amount of the monetary value). In such an embodiments, the benefit output device 304 may comprise a printing and document dispensing mechanism. In yet another example, the gaming device 300 may provide electronic credits as a benefit (which, e.g., may be subsequently converted to coins and/or tokens and dispensed from a hopper into a coin tray). In such embodiments, the benefit output device 304 may comprise a credit meter balance and/or a processor that manages the number of electronic credits that is indicated on a display of a credit meter balance. In yet another example, the gaming device 300 may credit a monetary amount to a financial account associated with a player as a benefit provided to a player. The financial account may be, for example, a credit card account, a debit account, a charge account, a checking account, or a casino account. In such embodiments, the benefit output device 304 may comprise a device for communicating with a server on which the financial account is maintained.

Note that, in one or more embodiments, the gaming device 300 may include more than one benefit output device 304. For example, the gaming device 300 may include both a hopper and hopper controller combination and a credit meter balance. Such a gaming device 300 may be operable to provide more than one type of benefit to a player of the gaming device 300. A single benefit output device 304 may be operable to output more than one type of benefit. For example, a benefit output device 304 may be operable to increase the balance of credits in a credit meter and communicate with a remote device in order to increase the balance of a financial account associated with a player.

The processor 305 may also be operable to communicate with a display device 306, which may be a component of gaming device 300. The display device 306 may comprise, for example, one or more display screens or areas for outputting information related to game play on the gaming device, such as a cathode ray tube (CRT) monitor, liquid crystal display (LCD) screen, or light emitting diode (LED) screen. In one or more embodiments, a gaming device 300 may comprise more than one display device 306. For example, a gaming device may comprise an LCD display for displaying electronic reels and a display area that displays rotating mechanical reels.

In one embodiment, a display device 306 comprises a video touch screen operable to output information and receive inputs from a player via the player touching predetermined areas of the screen. It should be appreciated that one or more embodiments may include storing graphic and/or sound elements that are used to construct a menu of options available for a player's selection via a touch screen. These elements may be store, for example, in EEPROM, flash memory, hard disk, CD ROM, or in any other suitable storage device. The menu may be displayed via any suitable display device, such as a CRT, LCD, VFC, LED display. In one embodiment, the menu may be implemented using only dedicated electromechanical switches. In one embodiment, a player operates an input device of the gaming device 300 to cause such a menu to be displayed. In one embodiment, a gaming device includes a touch screen and a touch screen controller (not shown) associated with a video monitor display device. The touch screen and touch screen controller may be operable to communicate with a video controller of the video monitor display device and a processor (e.g., processor 305 of gaming device 300). Thus, a player may be enabled to indicate decisions (e.g., a desire to purchase entry into a bonus round and/or establish an credit meter balance based on a result of one or more bonus rounds rather than corresponding to an amount of monetary input) by touching the touch screen in the appropriate places.

In one embodiment, display of the menu of player options preempts display of other information. For example, in one embodiment the same display device or screen used to display game play elements (e.g., video reels of a slot machine) during active game play may be used to display a menu of available options. In another embodiment, a dedicated display device or screen may be used to display a menu of available options on a continuous, periodic, or other basis.

The processor 305 may also be in communication with one or more other devices (not pictured) besides the display device 306, for outputting information (e.g., to a player or another device). Such other one or more output devices may also be components of a gaming device 300. Such other one or more output devices may comprise, for example, an audio speaker (e.g., for outputting an outcome or information related thereto, in addition to or in lieu of such information being output via a display device), an infra-red transmitter, a radio transmitter, an electric motor, a printer (e.g., such as for printing cashless gaming vouchers), a coupon or product dispenser, an infra-red port (e.g., for communicating with a second gaming device or a portable device of a player), a Braille computer monitor, and a coin or bill dispenser. For gaming devices, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

As indicated above, the display device 306 may comprise, for example, one or more display areas. For example, one of the display areas may display outcomes of games played on the gaming device 300 (e.g., electronic reels of a gaming device). Another of the display areas may display rules for playing a game of the gaming device 300. Yet another of the display areas may display the benefits obtainable by playing a game of the gaming device 300 (e.g., in the form of a payout table). In one or more embodiments, the gaming device 300 may include more than one display device 306, one or more other output devices, or a combination thereof (e.g., two display devices 306 and two audio speakers).

The processor may also be in communication with an input device 308, which is a device that is capable of receiving an input (e.g., from a player or another device) and which may be a component of gaming device 300. An input device 308 may communicate with or be part of another device (e.g. a computer 102 or 202, another gaming device, etc.). Some examples of input devices 308 include: a bar-code scanner, a magnetic stripe reader, a computer keyboard or keypad, a button, a handle, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device or from a another device such as a smart card or PDA of a player), and a weight scale. For gaming devices 300, common input devices 308 may include a button or touch screen on a video poker machine, a lever or handle connected to the gaming device, a magnetic stripe reader to read a player tracking card inserted into a gaming device, a touch screen for input of player selections during game play, and a coin and bill acceptor.

The processor 305 may also be operable to communicate with a payment system 310, which may be a component of the gaming device. The payment system 310 is a device capable of accepting payment from a player (e.g., a bet or initiation of a balance) and/or providing payment to a player (e.g., a payout). Payment is not limited to money, but may also include other types of consideration, including products, services, and alternate currencies. Exemplary methods of accepting payment by the payment system 310 include (i) receiving hard currency (i.e., coins or bills), and accordingly the payment system 310 may comprise a coin or bill acceptor; (ii) receiving an alternate currency (e.g., a paper cashless gaming voucher, a coupon, a non-negotiable token), and accordingly the payment system may comprise a bar code reader or other sensing means; (iii) receiving a payment identifier (e.g., a credit card number, a debit card number, a player tracking card number) and debiting the account identified by the payment identifier; and (iv) determining that a player has performed a value-added activity (e.g., participating in surveys, monitoring remote images for security purposes, referring friends to the casino).

The processor 305 may also be operable to communicate with a memory 312 and a communications port 314 (e.g., for communicating with one or more other devices). The memory 312 may comprise an appropriate combination of magnetic, optical and/or semiconductor memory, and may include, for example, Random Access Memory (RAM), Read-Only Memory (ROM), a compact disc and/or a hard disk. The memory 312 may comprise or include any type of computer-readable medium. The processor 305 and the memory 312 may each be, for example: (i) located entirely within a single computer or other device; or (ii) connected to each other by a remote communication medium, such as a serial port cable, telephone line or radio frequency transceiver. In some embodiments, the gaming device 300 may comprise one or more devices that are connected to a remote server computer for maintaining databases.

The memory 312 stores a program 316 for controlling the processor 305. The processor 305 performs instructions of the program 316, and thereby operates in accordance with the present invention(s), and particularly in accordance with the methods described in detail herein. The program 316 may be stored in a compressed, uncompiled and/or encrypted format. The program 316 furthermore includes program elements that may be necessary, such as an operating system, a database management system and "device drivers" for allowing the processor 305 to interface with computer peripheral devices 302, 304, 306, 308, 310, 312, 314. Appropriate program elements are known to those skilled in the art, and need not be described in detail herein.

According to some embodiments of the present invention, the instructions of the program 316 may be read into a main memory from another computer-readable medium, such from a ROM. Execution of sequences of the instructions in program causes processor perform the process steps described herein. In alternate embodiments, hard-wired circuitry may be used in place of, or in combination with, software instructions for implementation of the processes of the present invention. Thus, embodiments of the present invention are not limited to any specific combination of hardware and software. As discussed with respect to aforementioned systems 100, 200, execution of sequences of the instructions in a program 316 of a peripheral device 210 in communication with the gaming device 104 may also cause the processor 300 to perform some of the process steps described herein.

The memory 312 may also store a plurality of databases 318, 320, 322, including a probability database 318, a payout database 320, and a parameter value database 322. Example of some or all of the data stored in each database 318, 320, 322 is described herein. The described entries of the databases 318, 320, 322 represent exemplary information only; those skilled in the art will understand that the number and content of the entries can be different from those illustrated herein. Further, despite any description of the databases 318, 320, 322 as tables, an object-based model could be used to store and manipulate the data types of the present invention and likewise, object methods or behaviors can be used to implement the processes of the present invention.

Note that, although these databases 318, 320, 322 may be described as being stored in a gaming device 104, in other embodiments of the present invention some or all of these databases 318, 320, 322 may be partially or wholly stored in another device, such as one or more of the peripheral devices 210, 212, 214, the peripheral device server 216 and/or the server computer 102, 202. Further, some or all of the data described as being stored in the databases 318, 320, 322 may be partially or wholly stored (in addition to or in lieu of being stored in the memory 312 of the gaming device 140) in a memory of one or more other devices, such as one or more of the peripheral devices 210, 212, 214, the peripheral device server 216 and/or the server computer 102, 202.

In one or more embodiments, a gaming device 300 may include a player tracking module (e.g., an input and/or output device of the gaming device may comprise a player tracking module). A player tracking module may comprise a reader device for reading data from player tracking cards and/or smart cards, such that (i) players may be identified, and (ii) various data associated with players may then be determined (e.g., a package or contract previously purchased by the player, a number of cashable credits; a number of promotional credits that may not be redeemed for cash; a number of accumulated loyalty points; a number of accumulated game elements such as symbols, cards or hands; etc.). In one example, a card reader device may determine an identifier associated with a player (e.g., by reading a player tracking card comprising an encoded version of the identifier), such that the gaming device may then access data (e.g., of a player database, as described) associated with the player. In another example, a smart card reader device may determine data associated with a player directly by accessing a memory of an inserted smart card.

Thus, as known in the art, "smart cards" may incorporate (i) a memory, and (ii) means for accessing such a memory. For example, in one embodiment, the memory may store data related to aspects of the present invention. In one embodiment, data may be written to the smart card as a player plays one or more gaming devices (e.g., such that various data may be updated on a continuous, periodic or event-triggered bases). Accordingly, in one or more embodiments one or more devices operable to carry out various processes of the present invention (e.g., a gaming device or kiosk) may have associated therewith a smart card reader device, such that data may be read from the smart card pursuant to the execution of such processes. An example of a smart card system that may be used to implement one or more embodiments is the s-Choice™ Smart Card Casino Management System from Smart Card Integrators, Inc.™.

Further, as known in the art, a gaming device may comprise a player tracking module comprising (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

Of course, other non-card-based methods of identifying players are contemplated. For example, a unique identification code may be associated with the player. The player may then be identified upon providing the code. For example, the code may be stored (e.g., within a database maintained within the gaming device and/or a server) such that the player may enter the code using an input device of a gaming device, and accordingly be identified. In other embodiments, player biometrics may serve as identification means (e.g., a player is identified via a thumbprint or retinal scan). In further embodiments, a barcode of a cashless gaming ticket may encode a player identifier.

Thus, as described, various data associated with a player may be tracked and stored (e.g., in an appropriate record of a centrally-maintained database), such that it may be accessed as desired (e.g., when determining promotional offers or rewards to be provided to players, when determining the status of player with respect to a particular game or period of gambling activity, and so on). Further, various statistics may be measured in association with a player (e.g., coin-in statistics, win/loss statistics) and similarly accessed.

Various systems for facilitating such monitoring are contemplated. For example, a two-wire system such as one offered by International Gaming Systems (IGT) may be used. Similarly, a protocol such as the IGT SAS™ protocol or the IGT SuperSAS™ protocol may be used. The SAS™ protocol and the SuperSAS™ protocol each allows for communication between gaming machines and slot accounting systems and provides a secure method of communicating all necessary data supplied by the gaming device to the online monitoring system. One aspect of the SAS™ protocol, as well as the SuperSAS™ protocol, that may be beneficial in implementing aspects of the present invention is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity in order to determine player outcomes, coin-in statistics, win/loss statistics and/or any other data deemed relevant.

In one or more embodiments, aspects of the present invention, such as allowing a player to purchase entry into a bonus round and/or pay to establish a credit meter balance based on the results of a bonus round rather than setting the credit meter balance to an amount that corresponds to an amount of monetary input provided by the player, may be practiced by replacing and/or augmenting one or more components (e.g., hardware and/or software components) of an existing gaming device. Thus, in one or more embodiments, the invention may be applied as a retrofit or upgrade to existing gaming devices currently available for play within various casinos.

For example, a memory (e.g., computer chip) of the gaming device may be replaced or added, the replacement or additional memory storing a program for instructing the processor of the gaming device to operate in accordance with one or more embodiments. In another example, data output via the gaming device (e.g., graphical and/or textual data displayed on the gaming device) may be replaced or added, the replacement or additional data indicating to a player information relevant to one or more aspects of the present invention.

In a specific example, a gaming device may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. Forms of memory commonly found in gaming devices include electronically erasable programmable read-only memory (EPROM) and erasable programmable read-only memory (EEPROM). Thus, in one or more embodiments, an EEPROM storing software with instructions for carrying out aspects of the present invention (as well as instructions for carrying out other functions traditionally performed by the gaming device) may replace an EEPROM previously installed in a gaming device, such that the gaming device may be configured to operate in accordance with various processes of the present invention.

For example, a "bonus round purchase module" may be made available for purchase to various casino operators. The module, which may comprise various hardware and software (e.g., an EEPROM storing software instructions), may be installed in an existing gaming device (e.g., a video-reel slot machine, a video poker machine, etc.), such that when the module is installed, players of the device may elect (i) to play a game offered by the gaming device that does not incorporate aspects of the present invention, or (ii) to play a game offered by the gaming device in a manner that utilizes aspects of the present invention. Thus, players who are familiar with the games offered by various gaming devices may elect to pay for them in a different or similar manner as they are accustomed to.

Accordingly, a gaming device may be configured to allow a player to select one of two "modes" of the gaming device, and to enable the selected mode. If a player selects a "standard" mode, the gaming device may be configured to operate in a manner similar to how it operated before the installation of the module (e.g., the gaming device operates in a conventional manner, such that aspects of the present invention may not be utilized). If a player selects a "bonus round purchase" mode, the gaming device may then be operable to execute game play in accordance with one or more aspects of the present invention (e.g., by allowing the player to establish a credit meter balance based on results of one or more bonus rounds rather than setting the credit meter balance to an amount that corresponds to an amount of monetary input provided by the player).

In one example of allowing a player to select one or more modes, a touch-sensitive display screen may be configured to output a prompt asking a player to select a mode of operation. Such a prompt may be output in occurrence to various trigger conditions (e.g., coins, bills or tickets are inserted; a credit balance increases from zero to some other number; a player presses a "play" button; a motion, weight, infrared or other sensor detects the presence of a player; etc.). Accordingly, a player may select a mode of operation (e.g., by pressing an appropriately labeled icon of a touch-sensitive display screen), and upon receiving the player's selection, the gaming device may be configured to operate in the selected mode.

In other embodiments, as described, a peripheral device may be useful for implementing one or more embodiments into the operation of a conventional gaming device. For example, in order to avoid or minimize the necessity of modifying or replacing a program already stored in a memory of a conventional gaming device, an external or internal module that comprises a peripheral device may be inserted in, connected to or otherwise associated with the gaming device.

In still further embodiments, rather than configure existing gaming devices to execute aspects of the present invention by installing or connecting new hardware and/or software, software may be downloaded into an existing memory of one or more gaming devices. U.S. Pat. No. 6,805,634 to Wells et al. teaches methods for downloading data to gaming devices in such a manner. The entirety of U.S. Pat. No. 6,805,634 is incorporated by reference herein for all purposes. Thus, in some embodiments, an existing gaming device may be reprogrammed to accommodate new functionality of the present invention without the need, or by minimizing the need, to remove and replace hardware within the gaming device.

As discussed herein, in one or more embodiments, the gaming device 300 may take the form of a slot machine configured to operate in conjunction with the present invention. A more specific description of a slot machine suitable for use with the present invention follows.

Figure 4:
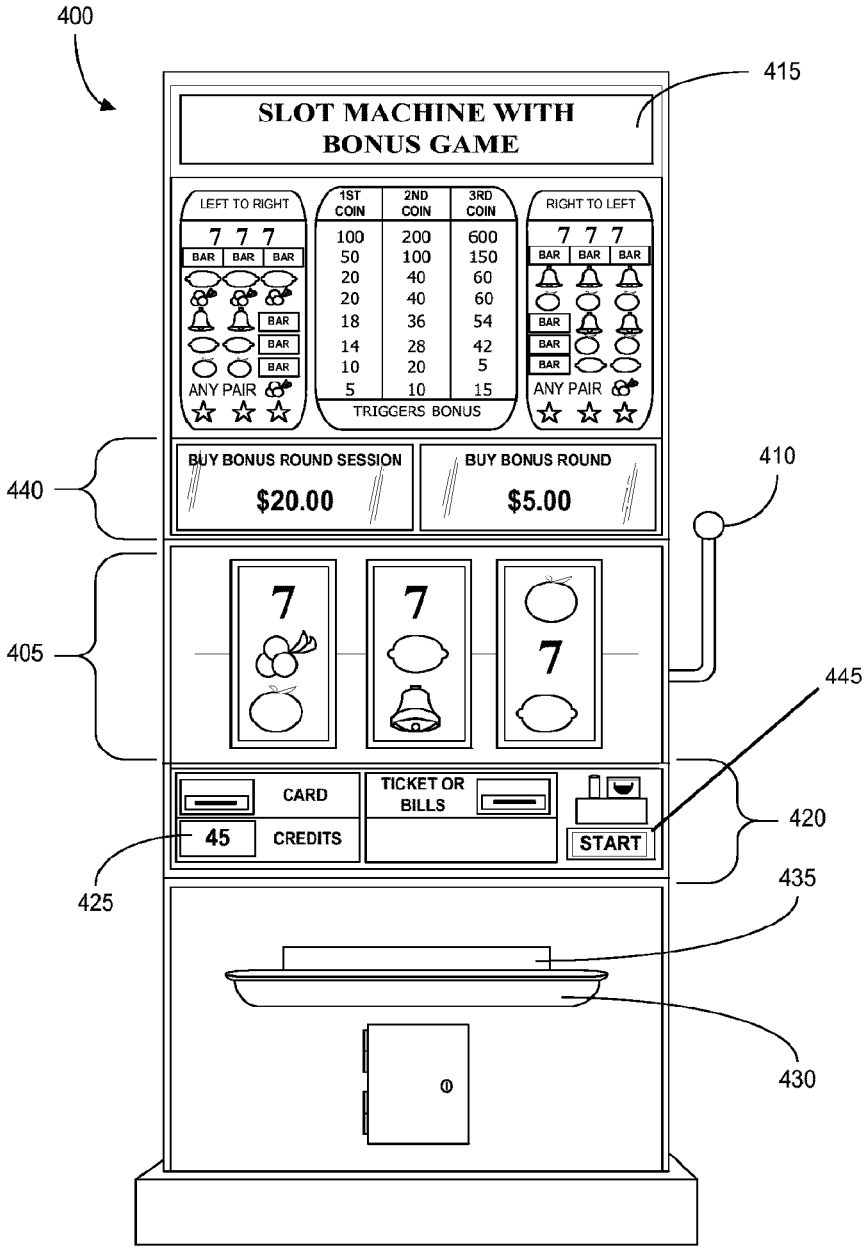
FIG. 4 is a plan view of an example gaming device according to some embodiments.

Referring now to FIG. 4, illustrated therein is a plan view of an example embodiment 400 of a gaming device in the form of a slot machine. Embodiment 400 is referred to as slot machine 400 herein. Generally, a slot machine for use in the present invention may, in one embodiment, comprise a three reel or five reel slot machine.

The slot machine 400 comprises a display area 405 in which an outcome for a base game of the slot machine is displayed to the player. The display area 405 may, for example, be a video display that displays graphical representations of reels. The display area may, in another example, be glass behind which are located mechanical reels. Within the display area is a payline. In accordance with one or more embodiments of the present invention, an outcome of a base game is a set of symbols displayed along a payline of a reeled slot machine.

The slot machine may further comprise a handle 410 or other means for initiating a game play or bonus round. A player may initiate the movement of the reels in the display area by pulling on the handle 410. Alternatively, a player may initiate the movement of the reels in the display area 405 by actuating a start button 445. Either or both of the handle 410 and start button 445 are exemplary embodiments of the input device 308 (FIG. 3), described herein.

The slot machine 400 may also include an alternate, secondary game screen 415, for outputting information to a player. The secondary game screen 415 may be utilized, for example, to output bonus game information (e.g., by displaying animated video for the bonus game and a result of a bonus round).

The slot machine 400 may also include a payment system 420 (which may be, e.g., a form of payment system 310 if FIG. 3), which is comprised of a bill acceptor, a credit card reader, cashless receipt/ticket reader, and a coin acceptor. A player may utilize payment system 420 to provide a wager for playing a game and or for providing payment for provision of an outcome.

The slot machine may further comprise a credit meter balance 425, which is an exemplary embodiment of a benefit output device 304 (FIG. 3) as described herein. The credit meter balance 425 indicates the amount of electronic credits currently available to a player for wagering and/or providing payment for options available via the slot machine 400. The electronic credits may be used by a player, for example, as wagers for game plays played on the gaming device and/or for providing payment for a play session and/or one or more bonus rounds. The electronic credits may also be "cashed out" as coins, bills, tokens, a cashless gaming receipt, and/or credits to another financial account associated with the player.

The slot machine 400 may further comprise a coin tray 430 and a ticket-in/ticket-out device 435. Payment to the player may be rendered, for example, by dispensing coins into the coin tray or outputting a cashless gaming receipt from the ticket-in/ticket-out device 435. Such payment may be rendered based on, for example, a player's indication that the player would like to cash out his credit meter balance and/or a payout obtained by a player as a result of playing a game on the slot machine. The coin tray 430 and the ticket-in/ticket-out device 435 is each an exemplary embodiment of the benefit output device 304 (FIG. 3) as described herein. Note that, where appropriate, the slot machine may include different and/or additional components besides those discussed above.

The slot machine 400 may further comprise a player interface 440. A player interface, as the term is used herein, may comprise a component of a device (e.g., slot machine 400) operable to receive input from a player and/or to output information to a player regarding one or more options available to the player via the device. For example, a player interface may be operable to receive input from a player such as an indication to purchase an entry into one or more bonus rounds and or a selection indicating that the player desires to establish an initial credit meter balance based on a session of bonus rounds rather than having the initial credit meter balance set to an amount that corresponds to an amount of monetary input provided by the player. In another embodiment, a player interface may be operable to receive input from a player comprising a value for a parameter (e.g., such as number of lines to be played or the amount of the wager per spin).

In one embodiment, a user interface 440 may comprise a number of physical buttons (e.g., mechanical or electromechanical buttons) that are actuated to initiate one or more functions or subroutines. For example, the player might actuate a button labeled "Cashout" to end a gaming session. In another example, a player might actuate a button labeled "Buy Bonus Round for $10.00" in order to initiate a bonus round in exchange for the specified payment. In one embodiment, a player interface comprises a plurality of mechanical or electromechanical buttons, wherein each button is operable to display information about an option available to the player.

In another embodiment, a player interface 440 may comprise a touch screen depicting a menu of options available to the player, wherein the player selects an option by touching an area of the touch screen that corresponds to the option. In one embodiment, a player interface comprising a touch screen may be selectively output. For example, a player may be presented with the menu of options upon indicating a desire to consider purchasing an option and/or upon initiating play at the slot machine 400.

In one embodiment, a player interface comprising a touch screen or another form may be displayed on the same display device that displays other information. For example, secondary game screen 415 may be operable to, at one time, output animated video of a bonus round and, at another time, output a menu of options available to the player.

In one embodiment, a single display device may be operable to simultaneously display two or more types of information. For example, the same display device may be operable to display a payout table and a menu of options available to the player (e.g., one or more sessions of bonus rounds available for purchase, and the corresponding prices and/or prizes corresponding to each such session).

In one embodiment, information displayed via a player interface 440 may be updatable (e.g., based on an input from a processor and/or casino personnel).

In one embodiment, any and all of the display devices described herein (e.g., display area 405, secondary display screen 415) may comprise a player interface.

In the particular embodiment of FIG. 4, the player interface 440 includes two electromechanical buttons, wherein one of the buttons enables a player to purchase a single bonus round for $5.00 and another of the buttons enables a player to purchase a bonus round session for $20.00.

In one embodiment, a player may be allowed to purchase entry into a bonus round at any time during play of the base game of a gaming device. In another embodiment, the times at which a player may be allowed to purchase entry into a bonus round may be restricted in one or more manners. For example, a button corresponding to a purchase of a bonus round may be activated and thus actuatable to cause a subroutine consisting of initiating a bonus round in exchange for a payment at some times but not at others.

In one embodiment, a player may be allowed to purchase a session of bonus rounds at the initiation of play on a gaming device (e.g., prior to establishing a credit meter balance) as a novel method of establishing a credit meter balance of credits available for wagering, as described herein. In such an embodiment, the results of the bonus rounds of the session may be used to determine the amount of credits to set the credit meter balance to, in lieu of setting the credit meter balance to an amount of credits that directly corresponds to an amount of payment provided by the player. In other words, in one embodiment, a value for a game play parameter comprising a credit meter balance may be determined based on a random number or event rather than set to a value that directly corresponds to an amount of payment provided by the player.

In one embodiment, the slot machine 400 may further comprise a spin meter (not shown), which may indicate the amount of spins currently available to a player or the number of spins for which a given parameter applies (e.g. double jackpots on the next 100 spins). The spin credits may be used by a player, for example, in lieu of wagers for games played on the gaming device. The electronic spin credits may be "cashed out" as coins, bills, tokens, a cashless gaming receipt, and/or credits to another financial account associated with the player. In other embodiments, spin credits may not be cashed out, or may be cashed out only at a discount.

Databases

As indicated above, it should be noted that although the example embodiments depicted in FIG. 3 include three particular databases 318, 320, 322 stored in memory 312, other database arrangements may be used which would still be in keeping with the spirit and scope of the present invention. In other words, the present invention could be implemented using any number of different database files or data structures, as opposed to the three depicted in FIG. 3. Further, the individual database files could be stored on different devices (e.g. located on different storage devices in different geographic locations, such as on a third-party server). Likewise, the program 316 could also be located remotely from the memory 312 and/or on another server. As indicated above, the program 316 may include instructions for retrieving, manipulating, and storing data in the databases 318, 320, 322, as may be useful in performing the methods of the invention as will be further described below.

1. Probability Database

Turning to FIG. 5A, illustrated therein is a tabular representation of an example embodiment 500 of a prior art probability database. Embodiment 500 is referred to as probability database 500 herein. A probability database 500 may be stored in a memory of a device (e.g., memory 312 of gaming device 300 and/or a memory of computer 102 or computer 202) in tabular form, or any other appropriate database form, as is well known in the art. The data stored therein may include a number of exemplary records or entries, each defining a random number. Those skilled in the art will understand that the probability database 500 may include any number of entries.

The probability database 500 may also define fields for each of the entries or records. The fields may specify: (i) a random number 505 or range of random numbers that may be generated by the random number generator 302; and (ii) an outcome 510, that indicates the one or more indicia comprising the outcome that corresponds to the random number of a particular record.

A gaming device (e.g., gaming device 104 of FIG. 1) may utilize a probability database 500 to determine, for example, what outcome corresponds to a random number generated by a random number generator 302 and to display the determined outcome. The outcomes may comprise the three symbols to be displayed along the payline of a three reel slot machine.

In some embodiments, a plurality of probability databases may be utilized. For example, a gaming device may offer a game play of a base game and a bonus round of a bonus game. The actuation of a game play of the base game may be associated with a first probability database (e.g., a probability table as indicated by FIG. 5A, indicating possible game play outcomes for a base game and random number ranges associated with such outcomes). The actuation of a bonus round of the bonus game may be associated with a second probability database (e.g., a probability table as indicated by FIG. 5B, indicating possible bonus round outcomes and random number ranges associated with such outcomes).

Referring now to FIG. 5B, illustrated therein is a tabular representation of an example embodiment 550 of a probability database that may be used to determine an outcome of a bonus round. Embodiment 550 is referred to as probability database 550 herein. A probability database 550 may be stored in a memory of a device (e.g., memory 312 of gaming device 300 and/or a memory of computer 102 or computer 202) in tabular form, or any other appropriate database form, as is well known in the art. The data stored therein may include a number of exemplary records or entries, each defining a random number. Those skilled in the art will understand that the probability database 550 may include any number of entries.

The probability database 550 may also define fields for each of the entries or records. The fields may specify: (i) a random number 555 or range of random numbers that may be generated by the random number generator 302 or another random number generator; and (ii) an outcome 560 that indicates the one or more indicia comprising the outcome of a bonus round that corresponds to the random number of a particular record.

A gaming device (e.g., gaming device 104 of FIG. 1) may utilize a probability database 550 to determine, for example, what outcome of a bonus round corresponds to a random number generated by a random number generator 302 or another random number generator and to display the determined outcome. The outcomes may comprise outcomes to be displayed via a secondary display of a gaming device.

As described, in one embodiment a bonus round may be a feature or aspect of a base game, distinct from the base game but supported by the base game, in which all outcomes are winning outcomes. Thus, assuming that all outcomes possible for a bonus round of a bonus game utilizing the probability database 550 correspond to a random number between zero ("0") and 100,000, the probability database 550 illustrates that all of the possible outcomes are winning outcomes in the embodiments utilizing this database. It should be noted that, for purposes of simplicity, the words "winning outcome" appear in field 560 as a generic description of an outcome corresponding to a range of random numbers. It should be understood that any other data may be stored in the field 560 as indicative or representative of an outcome. For example, an indication of one or more symbols, a video file depicting one or more events, a description of one or more events, and/or an audio file may be stored.

Other arrangements of probability databases are possible. For example, the book "Winning At Slot Machines" by Jim Regan (Carol Publishing Group Edition, 1997) illustrates examples of payout and probability tables and how they may be derived. The entirety of this book is incorporated by reference herein for all purposes.

2. Payout Database

Turning to FIG. 6A, a tabular representation of an embodiment 600 of a prior art payout database 320 according to some embodiments of the present invention is illustrated. Embodiment 600 is referred to herein as payout database 600. Where appropriate, a payout database 600 may be utilized in the performance of the inventive processes described herein. The payout database 600 may be used, for example, to determine an outcome for a game play of a base game. A payout database 600 may be stored in a memory of a device (e.g., memory 312 of gaming device 300 and/or a memory of computer 102 or computer 202) in tabular form, or any other appropriate database form, as is well known in the art. The data stored therein includes a number of example records or entries, each defining an outcome that may be obtained on a gaming device (e.g., gaming device 104 of FIG. 1) that corresponds to a payout. Those skilled in the art will understand that the payout database 600 may include any number of entries. The tabular representation also defines fields for each of the entries or records. The fields specify: (i) an outcome 605, which indicates the one or more indicia comprising a given outcome; and (ii) a payout 610 that corresponds to each respective outcome. The outcomes may be those obtained, for example, on a three reel slot machine.

A gaming device (e.g., gaming device 104) may utilize the payout database 600 to determine whether a payout 610 should be output to a player as a result of an outcome 605 obtained for a game play of a base game. For example, after determining the outcome 605 to output on the gaming device, the gaming device may access the payout database 600 to determine whether the outcome 605 for output is one of the outcomes stored as corresponding to a payout 610, e.g., "BAR, BAR, BAR" or "CHERRY, CHERRY, CHERRY" in FIG. 6A. If it is, the gaming device may provide the corresponding payout 610 to the player.

In some embodiments, a plurality of payout databases may be utilized. For example, a gaming device may offer a game play of a base game and a bonus round of a bonus game. The actuation of a game play of the base game may be associated with a first payout database (e.g., a payout table as indicated by FIG. 6A, indicating possible outcomes for a game play of a base game and the respective payout associated with each such outcome). The actuation of a bonus round of the bonus game may be associated with a second payout database (e.g., a payout table as indicated by FIG. 6B, indicating possible bonus round outcomes and the respective payout or bonus associated with each such outcome).

Turning to FIG. 6B, a tabular representation of an embodiment 650 of a payout database 320, for use in determining a payout or bonus for a bonus round and according to some embodiments of the present invention is illustrated. Embodiment 650 is referred to herein as payout database 650. Where appropriate, a payout database 650 may be utilized in the performance of the inventive processes described herein. A payout database 650 may be stored in a memory of a device (e.g., memory 312 of gaming device 300 and/or a memory of computer 102 or computer 202) in tabular form, or any other appropriate database form, as is well known in the art. The data stored therein includes a number of example records or entries, each defining an outcome that may be obtained for a bonus round on a gaming device (e.g., gaming device 104 of FIG. 1) and the respective bonus or payout that corresponds to each such outcome. Those skilled in the art will understand that the payout database 650 may include any number of entries. The tabular representation also defines fields for each of the entries or records. The fields specify: (i) an outcome 655, which indicates the one or more indicia comprising a given outcome of a bonus round; and (ii) a bonus 660 that corresponds to each respective outcome. The outcomes may be those obtained, for example, on a gaming device operable to facilitate a bonus game.

A gaming device (e.g., gaming device 104) may utilize the payout database 650 to determine whether a bonus 660 should be output to a player as a result of an outcome 655 obtained for a game play. For example, after determining the outcome 655 to output for a bonus round, the gaming device may access the payout database 650 to determine whether the outcome 655 for output is one of the outcomes stored as corresponding to a bonus 660. If it is, the gaming device may provide the corresponding payout 660 to the player. As described, in one or more embodiments, a bonus game may comprise a feature or aspect of a base game for which all outcomes correspond to a winning payout (i.e., a payout of a value greater than zero). Payout database 660 illustrates a payout database that may be used in such an embodiment. Assuming, for purposes of simplicity, that only the four outcomes illustrated in payout database 660 are obtainable for a bonus game, it can be seen that all of the possible outcomes correspond to a bonus of a value greater than zero.

Other arrangements of payout databases are possible. For example, the above incorporated book "Winning At Slot Machines" by Jim Regan illustrates examples of payout and probability tables and how they may be derived.

3. Parameter Value Database

Turning to FIG. 7, a tabular representation of an embodiment 700 of a parameter value database 322 according to some embodiments of the present invention is illustrated. Embodiment 700 is referred to herein as parameter value database 700. Where appropriate, a parameter value database 700 may be utilized in the performance of the inventive processes described herein. A parameter value database 700 may be stored in a memory of a device (e.g., memory 312 of gaming device 300 and/or a memory of computer 102 or computer 202) in tabular form as depicted in FIG. 7, or any other appropriate database form, as is well known in the art. The data stored therein includes a number of example records or entries, each defining the current parameter value associated with a given parameter as well as possible parameter values and/or the probabilities associated with the selection of parameter value symbols. Those skilled in the art will understand that the parameter value database 700 may include any number of entries. The tabular representation also defines fields for each of the entries or records. The fields specify: (i) a type of parameter 705; (ii) possible parameter values 710 associated with the parameter, (iii) probabilities 715 associated with the possible parameter values, and (iv) current values 720 associated with that parameter. A gaming device (e.g., gaming device 104) may utilize the parameter value database 700 to manage, track, and store parameter values throughout a gaming session.

In embodiments in which a value for a game play parameter comprising a credit meter balance is tracked, stored and/or determined, the parameter value database 700 may not be utilized. Instead, upon receiving a payment in exchange for determining a credit meter balance based on a result of one or more bonus rounds or game plays of a secondary game, a device (e.g., gaming device 104) may initiate the one or more bonus rounds, determine the payouts corresponding to the outcomes of the one or more bonus rounds, and set the credit meter balance to the sum of the payouts. Such a process is described in more detail below with respect to FIG. 10. A probability database for determining an outcome of a bonus round and a payout database for determining the payout corresponding to the outcome may be used to determine the outcomes and payouts of the one or more bonus rounds.

Methods

The systems discussed above, including the hardware components and the databases, are useful to perform the methods of the invention. However, it should be understood that not all of the above described components and databases are necessary to perform any of the present invention's methods. In fact, in some embodiments, none of the above described system is required to practice the present invention's methods. The system described above is an example of a system that would be useful in practicing the invention's methods.

Figure 8:
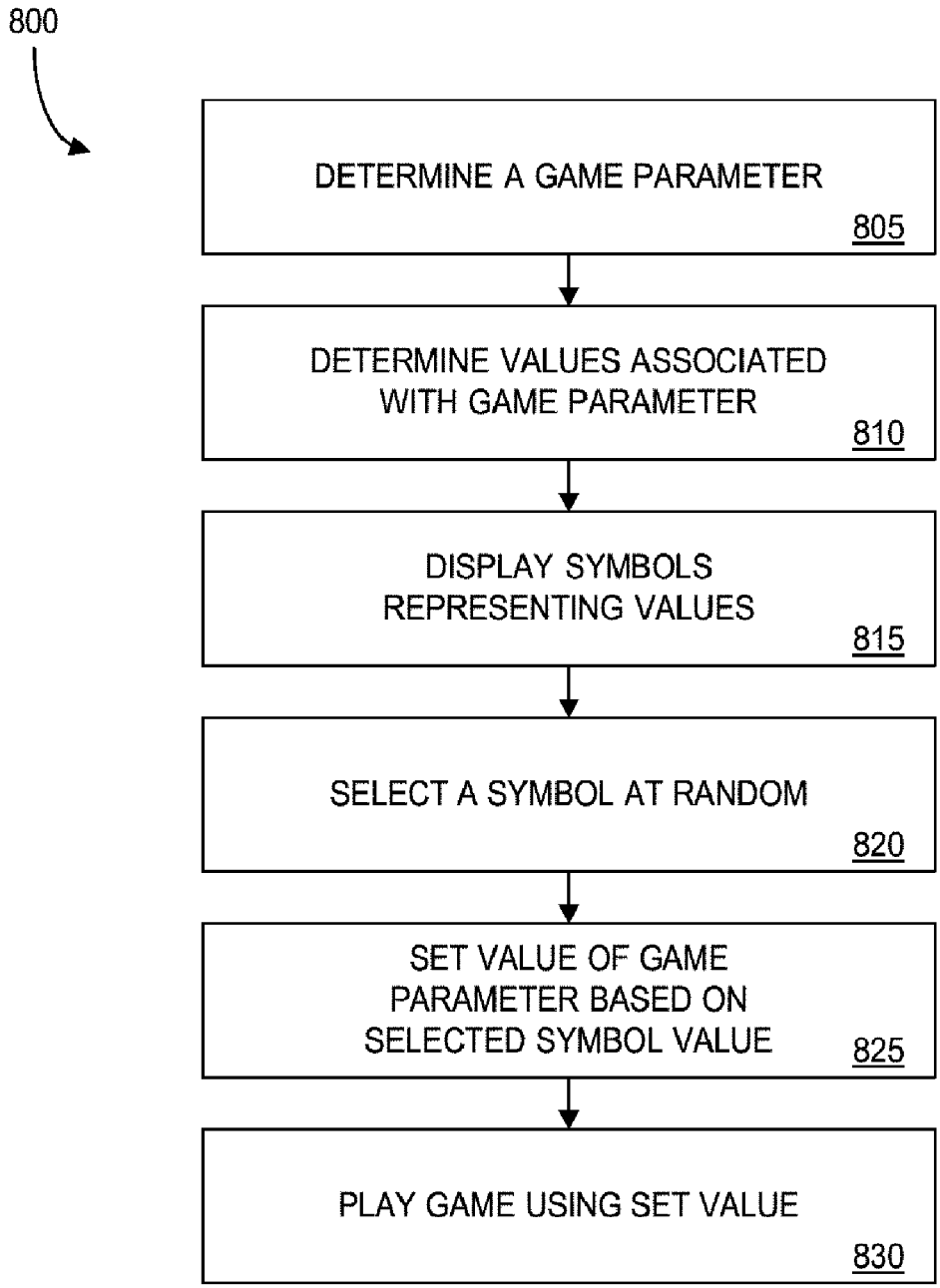
FIG. 8 is a flow chart illustrating an example process according to some embodiments.

Referring to FIG. 8, a flow chart 800 is depicted that represents some embodiments of the present invention that may be performed by a computer 102, a gaming device 104, a peripheral device 210, a peripheral device server 216, and/or a casino. It must be understood that the particular arrangement of elements in the flow chart 800 of FIG. 8, as well as the number and order of example steps of various methods discussed herein, is not meant to imply a fixed order, sequence, quantity, and/or timing to the steps; embodiments of the present invention can be practiced in any order, sequence, and/or timing that is practicable. Likewise, the labels used to reference the individual steps of the methods are not meant to imply a fixed order, sequence, quantity, and/or timing to the steps.

In general terms and still referring to FIG. 8, method steps of some embodiments may be summarized as follows. In Step 805, one or more game parameters are determined. In Step 810, possible values associated with these game parameters are determined. In Step 815, one or more symbols are displayed, for example, on a reel, each representing a possible value of the one or more game parameters. In Step 820, one or more of the displayed symbols are randomly selected. In Step 825, the value of one or more game parameters are set based on the randomly selected displayed symbols and in Step 830, the game is played using the set value. As indicated above, in some embodiments these steps may be performed in a different order, and that more/fewer/alternative steps may be used as well. The details of these example steps will now be discussed in depth.

1. Determine One or More Game Parameters

In some embodiments, the casino or gaming device 104 determines one or more game parameters. Game parameters are variables which can take on a variety of values and that may be adjusted during game play, stored in the parameter value database 322 of the gaming device 104. These parameters can serve to control one or more elements of slot machine play, such as those described below. Such parameters are especially useful for slot machine games which span a number of spins and in which multiple activities are happening both in a basic game (e.g. the spinning reels) and in secondary game elements (e.g. a secondary game screen where the player is accumulating puzzle pieces). These multi-spin games may require the player to prepay for a fixed number of handle pulls or a fixed amount of game play time. In some respects, the parameters determined may represent states of the gaming device 104.

Examples of parameters include: a number of game symbols to start a session with (e.g. number of carrots that a player is awarded as an initial starting value in a game spanning a number of spins); a multiplier value of payouts (e.g. all payouts over the next given number of spins multiplied by some value, the number of spins may also be a game parameter); a maximum number of spins allowed before player is ineligible for a puzzle completion bonus; a number of reels used in a game; a number of bonus symbols on each reel which initiate a bonus round; a rate of expiration of collected cherry symbols (e.g. a player might be paid 10 coins for each cherry accumulated over a twenty-five spin game, but the cherries gradually lose value after every handle pull—the expiration rate could be the number of credits in lost value per handle pull); a rate of accumulation of complementary (comp) points; a progression rate of a progressive jackpot; a payout for orange-orange-orange; a probability of bar-bar-bar; an amount of wager required per spin; a probability of a player getting into a bonus round; a number of puzzle pieces that need to be collected by a player during a puzzle game; a probability of bonus round payouts occurring (e.g. the portion of treasure chests selectable by the player that have a coin value); a number of whammy symbols which may reduce a player's credit balance; a number of handle pulls and/or an amount of time that a prepaid session and/or bonus game will last; and/or the like.

More than one game parameter may also be determined during this step. As an illustration of some embodiments of the present invention, the following "Garden Game" example will be referred to throughout the following example process steps. In the Garden Game (a three reel game), the player pays 20 credits for a single game which spans multiple handle pulls. His garden starts with a number of carrots, and the game includes a rabbit character that hops onto the screen to occasionally eat the carrots. The player can win coins on each spin, and the game continues until the rabbit has eaten all of the carrots. Two other game elements are included: a fox character and fence symbols. The fox can scare away the rabbit, and the fence symbols can be used to erect a full or partial fence around the garden, reducing the chance that the rabbit is able to steal one or more carrots.

A secondary screen shows a graphical image of the garden and carrots. Animated images of the rabbit and fox characters also are periodically displayed on the secondary screen. These game characters are activated by a reel symbol on the basic game occurring on a payline. For example, the first reel may have three rabbit symbols. When one of these appears on the payline, the gaming device animates the rabbit character on the secondary screen and has it steal one or more carrots. Fox symbols and fence symbols also appear on the reels and trigger their respective game elements to appear on the secondary screen. There are many possible parameters in this game, but for brevity, only the following four will be used in the illustration:

Number of carrots the player starts with
Number of rabbit symbols
Number of fox symbols
Number of fence symbols Other possible parameters, for example, would include the number of carrots that the rabbit steals on each attempt, the probability that the rabbit is successful in a steal attempt, the number of spins during which the fox is able to scare away the rabbit, the extent of coverage provided by each fence symbol, the probability of the rabbit knocking down a fence, the number of poisoned carrots (which could kill a rabbit), the coin value for achieving an outcome of fox-fox-fox on the payline, etc.

In some embodiments, players may be permitted to select which parameters they would like to see being determined or have changed from an initial value. In some embodiments, the parameters that are to be changed from an initial value may be selected at random.

2. Determine Possible Values Associated with these Game Parameters

Possible values associated with the parameter selected in the previous step are next determined. Once the values are determined they may be stored in the parameter value database 322 and then used in future game play (for the next handle pull, the next series of handle pulls, until a particular reel symbol appears on a payline, for a given amount of time, etc.)

The following examples of parameter values correspond to the first six example parameters described in the previous step. Values may include: starting a session with 8, 10, or 12 carrots; multiplying payouts over the next ten spins by factors of 2×, 3×, or 4×; the player becomes ineligible for bonus after 25, 30, or 35 spins; the game uses 3, 4, or 5 reels; each reel contains 2, 3, or 4 bonus symbols; and Cherry symbols expire with zero value after 40, 50, or 60 seconds. Note that some of the above parameter values are expressed as total or aggregate values. For example, "starting a session with 8, 10, or 12 carrots" indicates the total number of carrots that a player will start with at the beginning of his game session.

Continuing with the Garden Game example from the previous step, it can be seen how each of the four identified game parameters would have a range of possible values:

| Parameter | Possible Values |
|---|---|
| Number of carrots the player starts with | 8, 10, 12, or 15 |
| Number of rabbit symbols | 2, 4, or 6 |
| Number of fox symbols | 2, 4, 6, or 8 |
| Number of fence symbols | 16, 20, 24, or 30 |

Alternative ways of expressing the possible values may be used in this example embodiment of the invention. In the case of the number of carrots that the player starts with, for example, the possible values could be expressed as: a range of values (e.g. from 8 to 15 carrots); a formula (e.g. double the number of fox symbols); and/or probabilistically based values (e.g. 36% chance of 8, 36% chance of 10, 18% chance of 12, 10% chance of 15)

3. Display One or More Symbols on a Reel Each Representing a Possible Value of the One or More Game Parameters Reel symbols representing possible values of the game parameters may now be displayed. These symbols could be displayed on a single reel, or spread out over a number of reels. While they could be intermingled with the regular game symbols, in the current example embodiment, the game parameter value symbols are the only ones appearing on the reels, resulting in less confusion for the player.

Before the reel symbols with possible parameter values are displayed, the gaming device 104 could provide informational messages to the player indicating why the process was occurring. For example, the player might see an introductory screen which says:

"Let's see how many carrots you will get to start with—we'll fill the reels with carrot value symbols and spin them to see the total number of carrots you will start with. Good luck!"

In this example, the first reel could include a symbol representing 8 carrots, a second symbol representing 10 carrots, and a third symbol representing 12 carrots. Note that in this embodiment, no other symbols appear on the first reel, and no symbols appear at all on the second and third reels. That is, the entire set of reels is essentially cleared of basic game symbols, with the three game parameter value symbols then applied to the first reel.

Clearing of the reels could be accomplished in a variety of ways, and may be done in a manner that entertains the player in addition to carrying out the function of clearing the reels. During this process, all of the basic game symbols that appear on the reels are removed. For example, the cherries, plums, bells, sevens, bars, and oranges from a standard fruit machine may be cleared away to make room for the parameter value symbols. By "cleared away" it is meant that the normal game symbols are no longer visible to the player, or are clearly not active. Exemplary methods of generating the effect of clearing the reels include: digitally removing the game symbols (i.e. eliminating one or more reel stop positions from the electronic reels or turning one or more reel stop positions into blank symbols); graying out game symbols; making the symbols smaller so as to look almost insignificant (e.g. minimizing or reducing); animating the reels to make it look as though the reels with the normal symbols were being removed, replaced by a new set of reels containing possible game parameter value symbols; animating the reels to make it look like they are spinning, and then having a virtual blade appear to "scrape off" the symbols; and/or animating the reels to make it appear that they are being dipped in an acid solution which washes away the reel symbols.

Once the reels had been cleared of the normal game symbols, the symbols representing possible parameter values would be applied. As in the case of removing symbols, the applying process could be done in an entertaining manner, for example, by "dropping" the parameter value symbols from a secondary screen onto the reels and/or "dipping" the cleaned reels into a bucket containing the parameter value symbols, with some of all of the symbols sticking to the reels.

Instead of changing the reel symbols on the reels, the gaming device could "swap out" the basic set of reels and replace it with a set of reels containing parameter values. The swapping out process would be graphically represented in a way that made it clear that one set of reels was replacing another. For example, one set of reels could appear to be pushed back into the machine while the second set of reels appeared from the front of the machine to replace it.

In some embodiments, the regular reel symbols of the basic game maybe used to determine the parameter values by mapping each of the regular symbols directly to a corresponding game parameter value. For example in the Garden Game, a "BAR" symbol may represent a "carrot" game parameter with a value of three.

While the above examples may require a gaming device 104 with electronic reels, in some embodiments of the invention physical reels may be used to display the regular game symbols while a secondary screen is used to display the parameter value symbols.

It should be noted that the parameter value symbols could be generated to reflect fractions of the desired parameter values. In the example described above where the game parameter is the number of carrots to begin a session with, instead of having parameter value symbols of 8 carrots, 10 carrots, and 12 carrots an alternative arrangement could be used in which smaller carrot value symbols are spread out over all three reels in which the symbols are "added together" to generate the final parameter value. For example, the following reel symbol frequencies could be used:

$1^{st}$ reel—three "3 carrot" symbols and three "4 carrot symbols"

$2^{nd}$ reel—seven "2 carrot" symbols and two "4 carrot symbols"

$3^{rd}$ reel—five "3 carrot" symbols and four "4 carrot symbols"

After spinning this set of reels the player might receive a result of "3 carrot", "2 carrot", "4 carrot" for a total of nine carrots to begin the game with. Note that with this configuration of reel symbols, possible total parameter values include 8, 9, 10, 11, and 12 carrots (although not with equal probabilities). By varying the number of symbols associated with each symbol value, the probabilities of each possible final total value can be adjusted to fit the requirements of the game. In another embodiment, the player may spin the reels a number of times in order to determine the number of carrots to start with, with the total accumulated over a number of spins representing the new parameter value.

Note also that more than one set of parameter values could be displayed at the same time. To illustrate this example embodiment, the Garden Game example described above will be used. In this example, four parameter values need to be established: number of (1) carrots, (2) foxes, (3) rabbits, and (4) fences. In some embodiments, the player will see the reels cleared of the normal game symbols and replaced with the following parameter value symbols:

| | 15 value | 12 value | 10 value | 8 value | 6 value | 4 value | 2 value |
|---|---|---|---|---|---|---|---|
| First Reel | 2 carrot | 4 carrot | 8 carrot | 8 carrot | 0 carrot | 0 carrot | 0 carrot |
| Second Reel | 0 rabbit | 0 rabbit | 0 rabbit | 0 rabbit | 2 rabbit | 10 rabbit | 10 rabbit |
| Third Reel | 0 fox | 0 fox | 0 fox | 4 fox | 8 fox | 5 fox | 5 fox |

In the above table, the top row indicates the magnitude of the parameter value but not the identity of the corresponding parameter. The individual cells indicate both the parameter (e.g. carrot) and the number of symbols on that reel with that magnitude. For example, there are 4 carrot parameter value symbols which indicate a starting value of 12 carrots. While there are no fence symbols illustrated in the table, this parameter value could be set as double the number carrot symbols determined.

Note that in this example the total number of parameter value symbols on each reel is 22, providing a visual consistency to the player as the reels are spinning.

4. Randomly Select One or More Displayed Symbols

A random number may be generated by the random number generator 302 of the gaming device 104, and this random number may then be associated with an outcome in the parameter value database 322. For example, the random number 03459 might correspond to the result of "12 CARROTS." As discussed above, those of ordinary skill in the art will appreciate that there are many methods by which to determine a random number, such as algorithms stored in electronic memory or physical random number generators (such as a lottery blower type device).

In some embodiments, the processor 300 of the gaming device may then instruct a reel controller to spin the reels until they show a result of "12 CARROTS" on the payline of the first reel. In some embodiments, each parameter value symbol may have an equal probability of appearing on a payline, or the probabilities could be adjusted so that one or more parameter value symbols were more likely to be selected.

5. Set Value of One or More Game Parameter Based on the Randomly Selected Displayed Symbols The value of the game parameter is established according to the randomly selected displayed game parameter value symbol(s). For example, the value of the starting number of carrots for the game session may be established as 12 when a game parameter value symbol with a magnitude of 12 carrots appears on the payline.

Continuing with the Garden Game example, the payline of the reel spin might reveal an outcome of:

First Reel: 12 carrots

Second Reel: 6 rabbits

Third Reel: 2 foxes

The number of fence symbols would be double the number of carrots, or 24 fence pieces. These values are then stored in the parameter value database 322 within the gaming device 104, and are accessible by the processor 300 of the gaming device 104.

Once the values are determined they may be displayed to the player. Continuing with the Garden Game example, the number of carrots to begin with may be represented by populating a virtual garden in a secondary screen with the starting parameter value. A numeric meter could track the status of the number of carrots, decrementing each time a carrot was taken.

Turning now to particular embodiments of the present invention, Applicants have recognized that a desire of many players when playing a gaming device may be to reach the bonus round. However, many players are unable to reach the bonus round within a predetermined amount of time that the players deem acceptable, or within a predetermined budget, and may therefore become frustrated.

Applicants have further recognized that establishing a balance at a gaming device may not be exciting for a player. Conventionally, a player inserts currency into a gaming device and receives a credit balance proportional to the amount of currency inserted.

Figure 9:
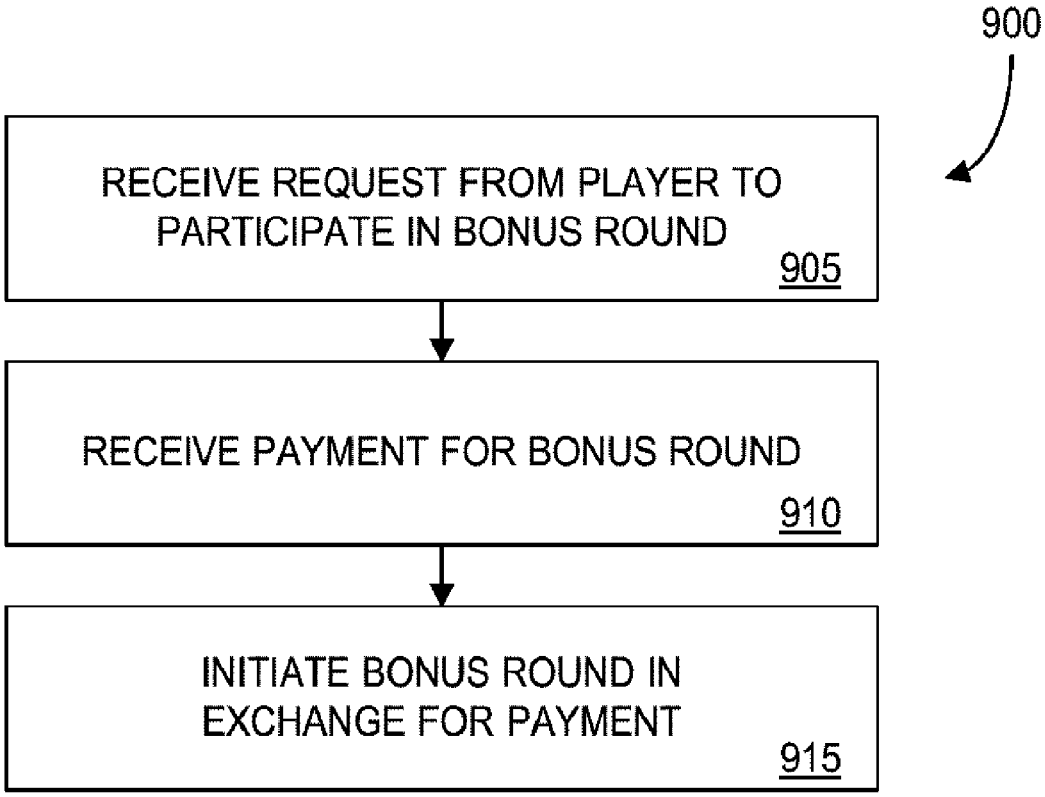
FIG. 9 is a flow chart illustrating an example process for initiating a bonus round, in accordance with some embodiments.
Figure 10:
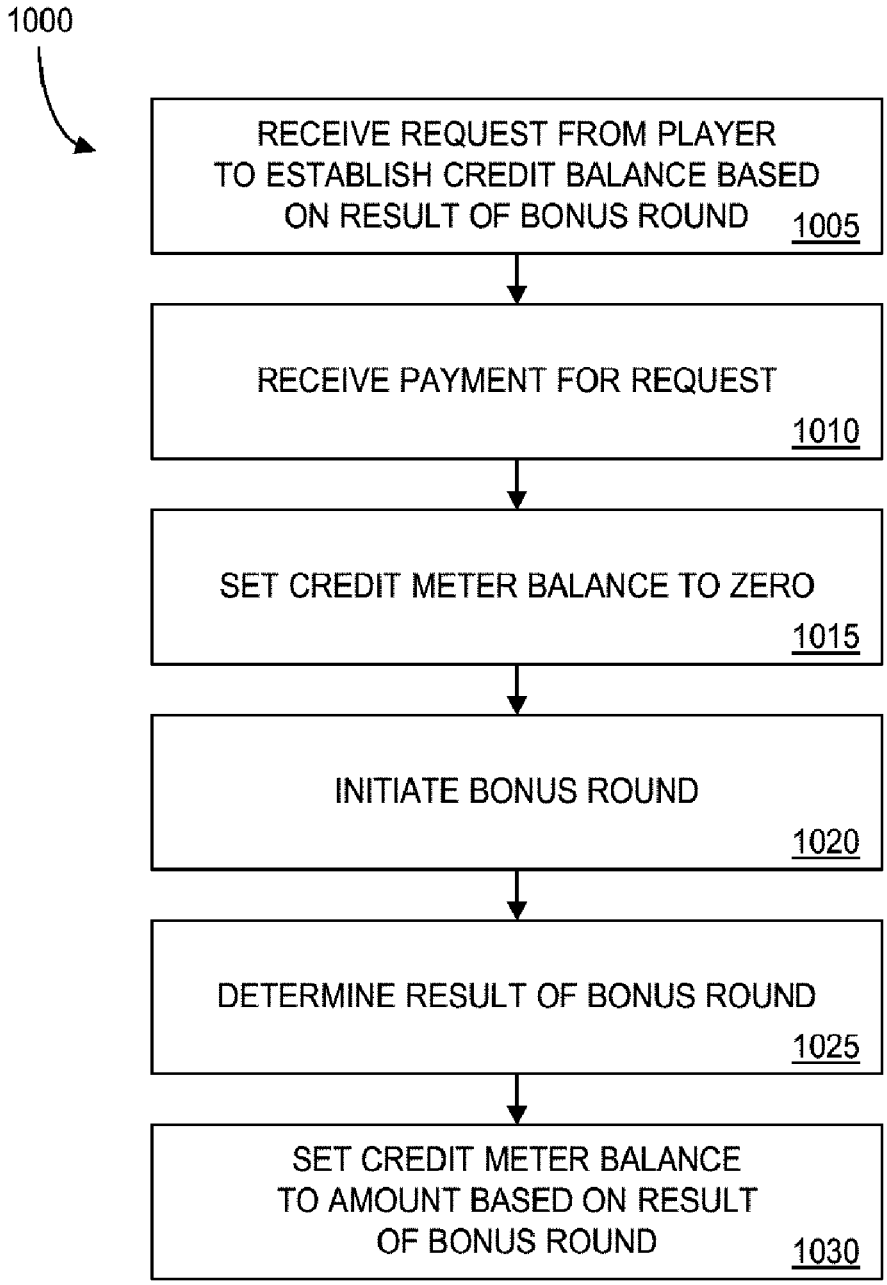
FIG. 10 is a flow chart illustrating an example process for establishing a credit balance, in accordance with some embodiments.

As described, various embodiments address the aforementioned and other needs by allowing a player to provide payment in exchange for guaranteed entry into one or more bonus rounds. The player may thereby experience enjoyment from playing bonus rounds without having to wait to win entry into the bonus round through standard play. Further, in various embodiments, a player may begin a session and establish an initial credit balance for wagering by providing a payment and by playing one or more bonus rounds. The payouts of the one or more bonus rounds may then constitute the player's starting balance for the session. The opportunity to start play with a random credit balance governed by the outcome of one or more bonus rounds may be exciting to the player. The player may have the opportunity to play one or more bonus rounds and to achieve a higher starting credit balance than he would have had the balance been solely proportional to the amount of currency inserted. FIG. 9 and FIG. 10, respectively, illustrate processes useful in implementing one or more embodiments that address the aforementioned and other needs.

Referring now to FIG. 9, a flow chart depicts an example process 900 that may be useful for implementing one or more embodiments. The process 900 may be performed by a computer 102, computer 202, one or more gaming devices, a peripheral device 210, a peripheral device server 216, and/or a casino.

In general terms and still referring to FIG. 9, method steps of some embodiments may be summarized as follows. In Step 905, a request to participate in a bonus round is received from a player. In Step 910, payment for the bonus round is received. In Step 915, a bonus round is initiated in exchange for the payment. The details of these example steps will now be discussed in depth.

1. Receive Request from Player to Participate in Bonus Round

In Step 905, an input may be received from a player, the input indicating the player's desire to participate in a bonus round. A gaming device may include various input devices by which a player may express his desire to engage in a bonus round. These input devices may include physical buttons, such as plastic buttons built into the housing of the gaming device. Input devices may also include virtual, or soft buttons, such as areas on a touch screen that a player may touch. A button may include a label such as, "Instant Bonus Round" or "Play Bonus Round Now." Other input devices may include a keyboard, via which a player may key in a command or request to engage in a bonus round. Input devices may also include microphones via which a player may verbally express a desire to engage in a bonus round. For example, a player may speak into a microphone and say, "I would like to play a bonus round please."

In one embodiment, a cashless gaming receipt may include a means for a player to indicate a desire to purchase a bonus round. For example, a cashless gaming receipt may include a box that a player may check, a circle that the player may fill in, or a section that the player may tear off in order to indicate that the player would like to purchase an entry into a bonus round using the cashless gaming receipt.

It should be noted that, irrespective of the manner in which the indication of the player's desire to purchase entry into a bonus round is received, the indication is received without the player first having to win the entry or otherwise obtain the entry by obtaining a qualifying outcome or other event in a base game that supports the bonus game.

As is well known, the input devices may be electrically and/or mechanically coupled to the processor of the gaming device. The processor may thereby interpret signals received from the input devices as requests by a player to initiate a bonus round, or as other messages depending on the particular input device.

2. Receive Payment for Bonus Round

In Step 910, a payment is received from the player, the payment being in exchange for entry into the bonus round requested in Step 905. The player may provide payment in many ways. Examples include: (i) inserting a bill into a bill validator; (ii) inserting coins into a coin slot; (iii) inserting a cashless gaming ticket/voucher into a reader device; (iv) entering a code associated with an amount of money; (v) swiping a credit card or cashless gaming card; (vi) electronically depositing funds into the gaming machine (e.g. via electronic funds transfer); and (vii) authorizing an amount of credits to be deducted from a credit meter balance.

The amount of the payment may be based on various factors. One factor may include the number of bonus rounds to be played. For example, a payment of $10 may be required if one bonus round is to be played, a payment of $20 may be required if two are to be played, and a payment of $30 may be required if three are to be played, and so on. Thus, in various embodiments, a payment for entry into one or more bonus rounds may be based on an amount of money, credits, currency, etc., that is proportional to the number of bonus rounds to be played. In various embodiments, the payment may be based on a "bulk discount" or other promotion. For example, a player may be asked to pay $10 if he requests to play one bonus round, but only $18 if he requests to play two.

In various embodiments, a payment in exchange for entry into one or more bonus rounds may be based on the expected payout of a bonus round. The expected payout may represent an arithmetic mean, or average number of credits to be won from a bonus round.

An expected payout may be computed via at least one of the following methods.

Method 1 for Computing an Expected Payout of a Bonus Round.

The various possible results, or outcomes of the bonus round are enumerated and represented by payouts. If there are N possible outcomes, the payouts for the outcomes may be represented by $x_1$ through $x_N$, where each $x_k$ has a numerical value represented a payout, e.g., in credits. For each payout, a corresponding probability is determined. The probabilities of the payouts may be represented by $p_1 \ldots p_N$, where $p_k$ represents the probability of payout $x_k$ occurring. The expected payout of the bonus round may then be computed as $\Sigma_{k=1 \ldots N} x_k p_k$.

Method 2 for Computing an Expected Payout of a Bonus Round.

Play of the bonus round is simulated a large number of times. For example, a computer processor steps through play of the bonus round, making decisions, such as random decisions, in place of the player, where appropriate. The payouts stemming from all of the simulated bonus rounds are averaged. For example, play of a bonus round is simulated one million times. Each of the simulated bonus rounds results in a payout. The resultant one million payouts are then averaged to arrive at an approximate expected payout for the bonus round. This method may be appropriate where there are a large number of possible payouts from a bonus round. For instance, a bonus round may involve the selection by a player of numerous locations that conceal prizes, with each prize contributing to the ultimate payout of the bonus round. Since there are potentially millions of different ways in which a player may select locations, there are a potentially large number of possible outcomes of the bonus round.

In one embodiment, process 900 may include a step of calculating or determining a payment amount for a requested entry into one or more bonus rounds. In another embodiment, such a payment may be determined as part of another process or subroutine (e.g., a process performed at a previous time and/or by another device) and stored in memory as well as output to players. For example, in one embodiment an entity (e.g., a casino, game designer, gaming device manufacturer and/or another entity) may configure one or more packages of bonus rounds (a package may include a single bonus round) and determine a price for each such package based on method 1 described above, method 2 described above, and/or another method. The gaming device via which at least one of the packages may be purchased (or another device, as desired or practicable) may store in memory an indication of the package and the payment corresponding thereto. The gaming device via which the package may be purchased (or another device, as desired or practicable) may also output an indication of the package and the payment corresponding thereto, as described herein. For example, an indication of the package and the payment corresponding thereto may be displayed via a menu (e.g., touch screen menu) or other button (e.g., mechanical or electromechanical button) of a gaming device, via which the player may indicate a desire to purchase the package and thus initiate the one or more bonus rounds defined by the package in exchange for the payment.

In one embodiment, the process 900 (e.g., as related to Step 910) may include prompting a player to insert the payment or requesting the payment from the player. Such a step may, for example, precede the step of receiving the payment from the player. A gaming device may request a payment from the player such that:

(i) The player receives true odds in the bonus round. In other words, the payment may be equal to the expected payout of the bonus round. This may be very attractive to the player, as there are very few bets that may typically be found in a casino at true odds. Players may therefore be attracted to the gaming device for the true odds bets. Once there, players may subsequently make other wagers at the gaming device where such wagers provide the casino with some expected profit.

(ii) The player receives better than true odds in the bonus round. In other words, the payment request of the player may be less than the expected payout of the bonus round. Such an opportunity to play a bonus round at better than true odds may be especially attractive to a player, since he stands to make money, on average. The player may subsequently be encouraged to remain at the gaming device and make other wagers, which are more beneficial to the casino.

(iii) The player receives worse than true odds in the bonus round. In other words, the payment requested of the player may be greater than the expected payout of the bonus round. This would ensure an expected profit for the casino.

In various embodiments, the gaming device may request payment based on a player's commitment to playing the gaming device in standard fashion after completion of the one or more requested bonus rounds. For example, if the player agrees to play for 200 spins following the completion of two bonus rounds, then the gaming device may request $18 payment for the two bonus rounds. However, if the player makes no agreement to play the gaming device in standard fashion following completion of the bonus rounds, then the gaming device may request $20 payment from the player.

In some embodiments, the player may be required or committed to playing the gaming device in a conventional fashion after play of the bonus round. For example, the player purchases a package of bonus round entries and conventional spins or plays. The player must complete the entire package, e.g., before he can cash out. Thus, bonus rounds favorable to the player may be bundled with conventional plays that are favorable to the casino.

3. Initiate Bonus Round in Exchange for Payment

In Step 915, the one or more bonus rounds requested in Step 905 are initiated, in exchange for the payment received in Step 910. In one embodiment, the bonus round may play like any conventional bonus round. The gaming device may show graphics and/or play audio representing a game, story, or other sequence. The player may make one or more decisions that affect the course of the bonus round. The bonus round may terminate, for example, after a predetermined sequence of events, after the player has made a predetermined number of decisions, after the player has made a predetermined number of losing decisions, after the player has obtained a predetermined payout, and so on.

In one embodiment, Step 915 or a subsequent step may comprise providing a payout or other prize that is a result of the one or more bonus rounds to the player. The payouts may be provided, for example, in the form of credits in a credit balance, coins in the coin tray, cashless gaming ticket, and so on. The payouts may then, in one or more embodiments, be used by the player for standard play of the gaming device. In various embodiments where the player has committed to standard play of the gaming device following play of the bonus round, the player may be unable to cash out the payouts of the bonus round(s) until after completing the standard play.

In one or more embodiments, it may be desirable that entry into a bonus round be seen as a privilege or special event. Accordingly, a player may be restricted in some manner as to how the player may purchase an entry into a bonus round.

As one example of a restriction on purchasing an entry into a bonus round, in various embodiments a player may be restricted from purchasing unlimited entries into a bonus round. In a more particular example, a player may be restricted to purchasing a predetermined or maximum number of entries per unit time. In a still more particular example, a player is only allowed to purchase up to two entries per hour.

As another example of a restriction on purchasing an entry into a bonus round, in various embodiments a player may be required to participate in a predetermined number of game plays using standard play of the gaming device between purchases of entries into a bonus round. In a more particular example, a player must make two hundred fifty spins of the reels of a slot machine, and corresponding wagers, between purchases of entries into bonus rounds.

As yet another example of a restriction on purchasing an entry into a bonus round, in various embodiments a player may be required to place a predetermined number or amount of wagers between purchases of entries into bonus rounds.

In one embodiment, to enforce limits on purchases of entries into bonus rounds, a gaming device may require an identifier of a player wishing to purchase entry into a bonus round. The gaming device may thus verify that the player is eligible to purchase a bonus round (e.g., that the same player has already purchased an entry in the past hour). If the player is eligible, then the player may be allowed to purchase the entry and to play out the bonus round. In some embodiments, the player's eligibility may be based on historic play data stored in association with a player (e.g., the player may purchase a bonus round if he has generated an amount of theoretical win for a casino that is above a predetermined threshold amount).

In various embodiments, a payout from a bonus round may be withheld until a player has completed a predetermined amount of standard play (e.g., a predetermined number of pulls, amount of time, or total wager amount).

When a player is not eligible to purchase an entry into a bonus round, the gaming device may display a message to this effect. For example, when a player tries to purchase an entry, the gaming device may say, "Sorry, you are not eligible to purchase entry into the bonus round at this time. To become eligible, you must play one hundred more spins at this device."

In one embodiment, restrictions on the purchase of an entry into a bonus round may not prevent a player from obtaining entry into a bonus round in a conventional fashion. For example, a player may complete a bonus round he has paid to play. The player may subsequently make a standard wager and participate in a game play of the gaming device by, for example, causing the reels of a slot machine to spin. The reels may stop to reveal a special outcome providing entry into the bonus round. The player may then play the bonus round again, even if he is no longer eligible to purchase an entry into the bonus round.

In various embodiments, a bonus round to which a player purchases entry may be different from a bonus round to which a player wins entry via e.g., a game play of the base game. For example, one or more possible payouts may be adjusted, or one or more possible probabilities of receiving the one or more payouts may be adjusted. In various embodiments, one or more adjustments may be made to the conduct of the purchased bonus round such that the expected payout of the purchased bonus round is less than the expected payout of the bonus round that is won. Otherwise, the play of the bonus rounds may be similar. In other words, the bonus rounds may have the same graphics, game theme, etc. In this way, entry into a bonus round that is won may be of greater value, or "more special" than entry into a bonus round that is purchased. In other embodiments, the expected payout of a bonus round that is purchased may be greater than the expected payout of a bonus round that is won. In still other embodiments, the expected payouts may be the same. In various embodiments, a maximum payout may be greater for the bonus round that is won than for the bonus round that is purchased, even the though the expected payouts may be the same.

Referring now to FIG. 10, a flow chart depicts an example process 1000 that may be useful for implementing one or more embodiments. The process 1000 may be performed by a computer 102, computer 202, one or more gaming devices, a peripheral device 210, a peripheral device server 216, and/or a casino.

In general terms and still referring to FIG. 10, method steps of some embodiments may be summarized as follows. In Step 1005 a request to establish a credit balance based on a result of one or more bonus rounds is received from a player. In Step 1010 a payment for the request is received. In Step 1015 a credit meter balance is set to zero. In Step 1020 a bonus round is initiated. In Step 1025 a result of the bonus round is determined. In Step 1030 the credit meter balance is set to an amount based on the result of the bonus round. The details of these example steps will now be discussed in depth.

1. Receive Request from Player to Establish Initial Credit Meter Balance Based on Result of Bonus Round As described herein, in one embodiment a player of a gaming device may be enabled to obtain an initial credit meter balance for a play session based on one or more random events (e.g., results of one or more bonus rounds) rather than based directly on an amount of funds provided by the player. Accordingly, in one or more embodiments a gaming device may be equipped with one or more means for allowing a player to indicate a desire to obtain a credit meter balance in such a novel manner. For example, a menu may be selectively displayed to a player (e.g., upon a player inserting a player tracking card into a component of the gaming device, upon a player indicating a desire to establish an initial credit meter balance in the novel manner, etc.) via a touch screen of a video display. In another example, a gaming device may be equipped with one or more mechanical or electromechanical buttons that a player may actuate to select this novel manner of establishing an initial credit meter balance for a play session. In Step 1005, it is determined that a request has been received from a player to establish an initial credit meter balance based on the result(s) of one or more bonus rounds. This request may be received, for example, upon a player actuating a button of the gaming device.

In one embodiment, a player may have previously purchased or received (e.g., from a kiosk or casino personnel) a ticket or other indicator that is readable by a gaming device as indicating that the player desires of one or more bonus rounds or random events that are to be used to establish an initial credit meter balance. In this latter embodiment, step 1005 may comprise receiving an input of this ticket or other indicator. In one example of an indicator, a player may provide a code or identifier (e.g., a player tracking card or smart card encodes a code or identifier, a player enters a code using an input device of a gaming device, and so on).

2. Receive Payment for the Request

In Step 1010, a payment for the request (and thus for the requested one or more bonus rounds) is received. The payment may be received in any of the manners described with respect to step 910 (FIG. 9). Further, any of the additional steps described with respect to step 910 (e.g., determining the payment, outputting a prompt or request for the payment) may equally be part of step 1010 or otherwise steps of process 1000. In embodiments in which a player purchases the entry into a bonus round in a manner other than via a gaming device (e.g., via a kiosk or casino personnel), the player may not be required to provide the payment but may rather, in step 1010, provide proof of the previously made payment. In one embodiment, the ticket or other indicia described with respect to step 1005 may serve as the proof of payment.

3. Set Credit Meter Balance to Zero

In Step 1015, the credit meter balance of a gaming device via which the play of the base game and/or bonus game is to take place may be set to zero. This may simply comprise verifying that the credit meter balance is set to zero. As described, in one or more embodiments a player may purchase a session, package or entry into one or more bonus rounds, wherein an initial credit meter balance is to be determined based on the result(s) of the one or more bonus rounds. Thus, it may be desirable to ensure that the credit meter balance is set to zero prior to initiating the one or more bonus rounds.

In some embodiments, a player may be allowed to purchase a session, package or one or more bonus rounds for determining a credit meter balance based on a random event (such as a result of a bonus round, wherein the outcome of the bonus round is based on a random number) at a time other than at the initiation of a play session or at a time other than prior to initiating a base game at a gaming device. For example, in the midst of playing a base game a player may decide to purchase a session of bonus rounds wherein the results of the bonus round will determine the amount of credits added to his credit meter balance. That is, the number of credits added to the credit meter balance will be a number that is based on the results of the bonus rounds, rather than a number that is proportional to a payment that the player provides for the session of bonus rounds. In this example, the player may or may not have had credits in the credit meter balance at the time of purchasing the session. If the player did have credits in the credit meter balance at the time of indicating a desire to purchase the session, the credits may be utilized to provide payment for the session. For example, an appropriate amount of credits may be deducted from the credit meter balance prior to an initiation of the bonus rounds of the purchased session. If the player did not have credits in the credit meter balance, the player may be required to provide the payment corresponding to the session the player desires to purchase. In one embodiment, once the player inserts the payment, the credit meter balance may not be increased to indicate a number of credits proportional to the payment (e.g., the credit meter balance may remain at zero, despite the insertion of funds to the gaming device by the player). In one embodiment, a display device other than a display of a credit meter (or a secondary display of the credit meter) may display an indication of the payment that was provided by the player for the session, without increasing the amount of credits in the credit meter balance based on the payment. In this manner, the player may be reassured that the gaming device accurately recognized the provision of the payment, even though the gaming device did not add the payment to the credit meter balance in the form of electronic credits.

4. Initiate Bonus Round

In Step 1020, the one or more bonus rounds purchased via steps 1005 and 1010 may be initiated. A bonus round may be initiated in any of the manners described with respect to Step 915 (FIG. 9).

5. Determine Result of Bonus Round

In Step 1025, a result of each respective bonus round of the one or more bonus rounds purchased via steps 1005 and 1010 may be determined. Determining a result of a bonus round may comprise, for example, determining a random number, determining the outcome that corresponds to the random number and determining the payout or other prize that corresponds to the outcome (e.g., utilizing a probability database of FIG. 5B and a payout database of FIG. 6). Other methods of determining a result of a bonus round would be readily appreciated by one of ordinary skill in the art upon reading the present disclosure.

In one embodiment, a player may purchase a single bonus round entry, wherein the result of the bonus round so purchased determines the player's initial credit meter balance for a play session. In one embodiment, a simple table, such as the one illustrated below, may be used to determine a result of a bonus round. The table below assumes that a player may purchase an entry into a bonus round for $20.00. In exchange for the player's payment of $20.00, a random number may be determined and the credit meter balance may be set to the amount of electronic credits equivalent to the initial credit meter balance that corresponds to the determined random number. As can be seen from the table, the player has a very small chance of winning an initial credit meter balance that is significantly greater than the $20.00 payment, a greater chance of winning an initial credit meter balance somewhat greater than the $20.00 payment, and a very small chance of winning an initial credit meter balance that is a little less than the $20.00 payment:

| Random Number | Initial Credit Meter Balance |
|---|---|
| 0 to 10 | $200 |
| 11 to 100 | $50 |
| 101 to 500 | $30 |
| 501 to 550 | $15 |

Of course, it should be understood that the data in the above table is exemplary only. For example, any number of random number ranges may be used. Similarly, different payment amounts may be used and amounts that differ in magnitude and relative magnitude to the payment amount may be used.

6. Set Credit Meter Balance to Amount Based on Result of Bonus Round

In Step 1030, the credit meter balance is set to indicate an amount of credits based on the result(s) of the one or more bonus rounds initiated in step 1020, for which results were determined in step 1025. Step 1030 may comprise increasing the credit meter balance by a number of credits that corresponds to the sum of the payouts determined in Step 1025.

EXAMPLE ILLUSTRATIVE EMBODIMENTS OF THE INVENTION

The following very specific additional examples are provided to illustrate particular embodiments of the present invention, particularly from the perspective of potential users of the system 100 or the system 200, including players and casinos.

Example 1

A player approaches a quarter denomination Wheel of Fortune® gaming device. Rather than spin the reels and hope to win a spin of the bonus Wheel, the player decides to purchase the spin of the Wheel directly. The player presses a "Play the Wheel" button on the gaming device. The gaming device then displays a message on the display screen that says, "Please Insert $10 in order to spin the Wheel." The player then inserts the $10. A "Spin" button then lights up on the gaming device. The player presses the button and hears the familiar refrain "Wheel of Fortune." The bonus Wheel begins to spin. The player watches it as it goes and then begins to slow down. The Wheel lands on a wedge with the number forty printed on it. The player thereby wins forty credits, getting his money back. The player is happy to have had a chance to play the bonus round without having to wait. He decides to sit down at the machine and try a bit of conventional play in which he spins the reels of the gaming device and tries to win payouts as well as further plays of the Wheel.

Example 2

A player approaches a gaming device. He navigates a set of menus on the touch screen of the gaming device in order to purchase a session of play. The session consists of the play of three bonus rounds in order to establish an initial credit balance. The session then consists of two hundred standard spins of the reels. The purchase price of the session is $50. The player requests to purchase the session. The gaming device asks the player to deposit $50, which the player does. The gaming device then prints a confirmation message. "Are you sure you want to play? Your initial credit balance will be determined by three plays of the bonus round, and may be less than $50. Also, you will not be able to cash out until after you have finished the two hundred spins. The player pressed the "I agree" button. The player then had the pleasure of playing three bonus rounds. When he finished the first, he went directly on to the second. When he finished the second, he went on to the third. The payouts from the three bonus rounds were added to provide the player with his starting credit balance. The player was fortunate to win two hundred thirty credits, more than he would have started with had he converted his $50 payment directly into credits. The player then played out the two hundred spins using his credit balance. After the two hundred spins, he was about even. Having enjoyed the experience, the player decided to purchase another session.

Example 3

A player inserts a bill into the bill validator of a slot machine and establishes a balance of 80 credits. He chooses to play a game in which he is allocated a number of carrots which populate a virtual garden on a secondary screen. These carrots are periodically stolen by a rabbit game character, with the rabbit stealing a carrot every time a rabbit symbol appears on the payline of one of the reels. The game costs 20 credits, and the player spins until all of his carrots are stolen. After providing the 20 credits to start the session, the slot machine establishes the parameter of the number of carrots the player will start with by clearing all of the reel symbols and replacing them with carrot symbols numbered 1, 2, 3, and 4. The player spins and gets 2-4-3 for a total of nine carrots. These nine carrots electronically populate the garden screen on the secondary screen. The carrot symbols are then removed from the reels and replaced with the normal reel symbols for the game. The player pulls the handle and the game plays normally.

Example 4

In the middle of the game described in Example 3 immediately above, the player gets a "scramble" symbol on the payline of one of the reels causing the reels to be immediately blanked out and repopulated with new symbols which will be used to determine new parameter values. The first reel contains only fox symbols, with values overlaid onto each fox ranging from 1 to 5. The next reel contains fence symbols with values from 10 to 20. The final reel has rabbit symbols, ranging from 1 to 3. The player presses the spin button and gets a result across the payline of fox 3, fence 8, rabbit 3. The slot machine then wipes out these fox, fence, and rabbit symbols and replaces them with the normal game symbols, except that the number of fox, fence, and rabbit symbols is dictated by the number obtained after the scramble symbol, i.e. the reels contain 3 fox symbols, 8 fence symbols, and 3 rabbit symbols.

Example 5

A player pays 20 credits for a game in which the object is to collect fruit over a period of 20 spins, with a payout at the end of the game based on the value of fruit collected. The collected fruit symbols change value every handle pull, ripening or deteriorating according to a fixed schedule associated with each fruit. After the last spin, the player has accumulated 36 pieces of fruit. But before the value of each fruit is totaled and provided to the player, a final spin is conducted to determine a multiplier value. All of the regular game symbols from each reel are deleted, and the first reel is repopulated with multiplier symbols ranging from 2× to 10×. The player presses a button and this single reel is spun, resulting in a multiplier value of 7× showing up on the payline. This multiplier value is then applied to the final aggregated value of the fruit collected by the player to determine a final payout value.

Example 6

A player pays 20 credits for a Monopoly-themed game in which the object is to earn rents from collected properties and avoid paying rents on the properties held by computer opponents. To begin the game, the gaming device randomly distributes the properties in groups. For example, all three red colored properties would be distributed together as a bundle rather than individually. The distribution process involves a spinner device which has a location for each Monopoly color group. The device is spun once for each player, and the color it lands on is the color group that the player now controls. The spinner continues to spin, allocating color groups to the player and to one or more computer opponents. Once the properties are distributed, the primary game begins in which the player's game token moves around an electronic representation of a Monopoly board. At several points during the game houses may be randomly distributed to the player and his computer opponent, using a similar spinner.

Additional Description of Some Embodiments

In one embodiment, a player may purchase a bonus round as a means for determining a cash-out amount, in lieu of simply cashing out a balance of the credit meter and receiving an amount of currency or cashless gaming receipt of a value equivalent to the amount of credits in the credit meter balance at the time of cash out. For example, assume a player has a first number of credits in a credit meter balance and desires to end his play session and cash out. A player may simply indicate a desire to cash out and be provided the first number of credits in one or more forms (e.g., a cashless gaming receipt redeemable for an amount of cash equivalent to the first number of credits, a number of coins or casino tokens equivalent to the first number of credits, etc.). However, in one or more embodiments, a player may also have the novel option of purchasing a bonus round for all or part of the first number of credits, wherein the result of the bonus round determines the final number of credits the player may cash out. The final number may be less than, equal to, or greater than the first number. For example, assuming the player has the ten credits in a credit meter balance, the player may be allowed to wager or provide all or part of these ten credits for a bonus round. The player may be allowed to do so at a time of the player's choosing, such that the player need not wait to win an entry into the bonus round but may select this option any time the player desires to cash out. The result of the bonus round may be determinative of the final number of credits that the player may cash out. Thus, for example, a random number may be generated and a table such as the following example table may be used to determine the final number of credits that the player may cash out:

| Random Number | Final Number of Credits |
|---|---|
| 0-10 | Current number × 20 |
| 11 to 100 | Current number × 5 |
| 101 to 200 | Current number × 10. but final credits are usable for wagering and not available for out |
| 201 to 10,000 | Current number × 2 |
| 10,000 to 10,100 | Current number × 0.5 |
| 10,101 to 10,125 | 0 credits |

For example, assuming the player is required to risk all of his current credits, the player has a small chance of multiplying the current number of credits by 20, a larger chance of multiplying his current number of credits by 5, a yet larger chance of multiplying his current number of credits by 10 (but only being able to use the credits for subsequent wagering, even if it is in a different play session), a relatively large chance of doubling his current number of credits, a small chance of decreasing his current number of credits by half, and a very small chance of losing all of his current credits. Of course, it should be noted that the data in the above table is exemplary only and variations thereof would be apparent to one of ordinary skill in the art upon reading the present description. For example, in another embodiment a player may be allowed to risk all or a portion of his credit meter balance at cash-out for a bonus round in which the player has a small chance at a relatively large number of credits (i.e., substantially larger than the player's current number of credits) and a relatively large chance at losing all of his current number of credits. For example, a player with a current credit meter balance of 15 credits may, at cash out, risk it all for a relatively small chance of tripling his balance to 45 credits and a relatively large chance of losing all of the credits. In one embodiment, a player may be provided with a choice of payout tables and/or probability tables to be used to determine the result of the bonus round (which is true for other embodiments described herein).

In some embodiments, instead of displaying the parameter values on the reels as reel symbols, some or all of the parameter values could be displayed on secondary screens—selected at random by the slot machine. For example, in the Garden Game discussed above, the gaming device 104 may determine the number of carrot symbols to start with through the use of a "spinner" displayed on a secondary screen. The spinner might have ten possible outcomes, ranging from 3 carrots to 15 carrots. The outcome randomly selected is the number of credits that the player starts with. While the process of initiating this parameter setting spin could come from the processor of the gaming device, the player himself might be allowed to initiate the spin—perhaps by pressing a button or touching a location on the secondary screen. In another embodiment, parameter values are displayed on one or more peripheral devices associated with the gaming device.

In some embodiments, instead of a random selection of the parameter values by the gaming device, a punchboard-like embodiment could be used in which a grid of locations is presented to the player. Applied in the context of the above-described Garden Game, the grid could contain symbols with parameter values, from which the player selected four locations. Each of the four locations would reveal a parameter value. If the player selects more than one of a particular parameter before all four parameter values have been determined, the player may be awarded the highest value chosen, or could be awarded the sum of both selections.

In some embodiments, the magnitude of the parameter value symbol could be determined after the parameter value symbol appeared on the payline. In such embodiments, a fox symbol might show up on the payline. A pair of dice are then animated on top of the parameter value symbol and they roll to form a number from 2 to 12, the resulting number being the final parameter value.

In some embodiments, parameter values could be established: before every spin; at the beginning of each game; at the conclusion of each game; upon request by the player; upon the occurrence of a random triggering event; at a predetermined time (e.g. every 100 spins); when a particular payout occurs; when the player inserts his player tracking card; when the player inserts a bill into the bill validator; and/or when the credit balance of the player reaches a predetermined level.

In some embodiments, the process of changing one or more game parameters may be triggered by actions of the player. Such actions might include: a player losing more than a given number of spins in a row; a player getting a given number of "close calls" in a row (e.g. two of the reel symbols match); a player losing more than a given number of dollars in a given number of minutes and/or a given number of handle pulls; a player depositing more than a given number of dollars into the machine; a player speeding up play; and/or a player slowing down play.

In some embodiments, the parameter selected in a game could be determined not by the magnitude of the parameter value chosen, but by the amount by which that parameter value grew over time. For example, in the case of the Garden Game the number of carrots to begin with may start at three and then increase by one for every handle pull of the gaming device—stopping when the player gets a fox symbol. Once the fox symbol appears, whatever level the number of carrots has risen to becomes the parameter value for the number of carrots to start with.

Although the Garden Game example describes an embodiment with a parameter value of the number of carrots to start with, other embodiments are possible in which the parameter value is not a starting value but a target ending value. For example, the player may prepay for a game and have the ability to keep pulling the handle at no additional cost as long as his balance of carrots did not build up to the parameter ending value determined at the beginning of the game. For example, if the parameter ending value were determined to be 12, the player might pull the handle until he had accumulated 12 carrot symbols from the reels.

Other embodiments of the present invention apply to table games such as blackjack, roulette, or craps. In the game of blackjack, for example, parameter values might include the number of decks to be used, whether or not the dealer stands on a soft 17, the amount of bonus paid for achieving a hand of 21 comprised of the 6, 7, and 8 of one suit, etc. In roulette, parameter values could include the number of chips that could be purchased for a $20 buy-in or the payout for hitting a single number. In each of these table game embodiments, peripheral devices could be attached to the table which allow the dealer or players to electronically or physically determine one or more parameter values.

In video poker embodiments, game parameters might include the number of cards in the deck, the payout for achieving a royal flush, a number of wildcards, then number of cards in a hand, whether or not any cards may be drawn (e.g. stud versus draw poker); and/or the identity of a bonus card which, when dealt, automatically doubles the payout earned for that hand.

In some embodiments, parameter values are used to configure or define game characters, their characteristics, and/or their behaviors. For example, the ability of a game character to alter one or more outcomes of the game or the probability that such a game character appears in the game are parameters that may be set using the present invention. Parameters could also be used to configure objects used by a player throughout a game, such as the engine size of a race car used by the player in a race conducted during a bonus round.

In some embodiments, parameter values "won" by a player may be stored for use during future gaming sessions. In some embodiments for example, a player may be provided with a cashless gaming receipt that includes an indication of the values of one or more game parameters that were determined for him during his gaming session. In some embodiments, a player's game parameters and/or values may be stored by a casino in a player database in association with a player identification number or on a player tracking card. For example, during a play session, a player may receive a random parameter determination outcome that entitles him to "one hour of play with half-priced wagers." However, after enjoying the discounted gaming for only fifteen minutes, the player realizes that he is late for an appointment and must leave. In some embodiments of the invention, the player may be presented with a choice to either cash out and forfeit his remaining forty-five minutes of discounted gaming or accept a cashless gaming receipt that indicates that if the player returns to the casino and applies the monetary face value on the cashless gaming receipt to future play, he will receive his unused forty-five minutes of play with half-priced wagers. In this manner, the player may preserve the "equity" he has in parameters and/or values he earns with the present invention. In some embodiments, a player may be provided with an opportunity to pay a fee to save or extend his parameter values for future use. In some embodiments, a player may pay a fee to increase or modify a game parameter value.

CONCLUSION

It is clear from the foregoing discussion that the disclosed systems and methods to facilitate setting game parameters represents an improvement in the art of gaming. While the method and apparatus of the present invention has been described in terms of its presently preferred and alternate embodiments, those skilled in the art will recognize that the present invention may be practiced with modification and alteration within the spirit and scope of the appended claims. The specifications and drawings are, accordingly, to be regarded in an illustrative rather than a restrictive sense.

Further, even though only certain embodiments have been described in detail, those having ordinary skill in the art will certainly appreciate and understand that many modifications, changes, and enhancements are possible without departing from the teachings thereof. All such modifications are intended to be encompassed within the following claims.

What is claimed is:

1. A method of facilitating play of a gaming device, said method comprising:

independent of any determined results of any plays of any base games, receiving, at the gaming device, a monetary payment associated with a first number of electronic monetary credits;

without adding the first number of electronic monetary credits to a designated monetary credit meter balance of the gaming device, initiating at least one play of a secondary game in response to receiving the monetary payment;

for each of the at least one play of the secondary game, causing at least one processor to:

(i) determine a result of said secondary game based on a random event, and (ii) display the determined result of the secondary game;

determining a second number of electronic monetary credits based on any quantity of electronic monetary credits resulting from the at least one play of the secondary game;

causing the designated monetary credit meter balance to display the second number of electronic monetary credits rather than the first number of electronic monetary credits, thereby establishing an initial monetary credit meter balance for wagering on at least one play of a base game of the gaming device using the second number of electronic monetary credits; and requiring at least one monetary credit of the initial monetary credit meter balance to be wagered on the at least one play of the base game of the gaming device.

2. The method of claim 1, further comprising receiving, at the gaming device, data indicative of a commitment from a player to participate in a designated quantity of game plays of the base game upon a completion of the at least one play of the secondary game.

3. The method of claim 2, further comprising:

determining whether the player has participated in the designated quantity of game plays of the base game; and upon determining that the player has participated in the designated quantity of game plays of the base game, providing an award to the player based on the then displayed designated monetary credit meter balance.

4. The method of claim 1, which includes, prior to receiving said monetary payment associated with the first number of electronic monetary credits, receiving a request from a player to establish the initial monetary credit meter balance based on at least one result of the at least one play of the secondary game.

5. The method of claim 1, which includes determining the result of at least one additional play of the secondary game upon an occurrence of a triggering event during at least one play of the base game resulting from the required wager.

6. The method of claim 1, which includes requiring at least one monetary credit of the initial monetary credit meter balance to be wagered on a gaming session, the gaming session associated with a plurality of plays of the base game provided in exchange for the required wager.

7. The method of claim 1, which includes determining the second number of electronic monetary credits based on any quantity of electronic monetary credits resulting from the at least one play of the secondary game and also based, at least in part, on the received monetary payment.

8. A gaming device comprising:

at least one processor;

at least one display device; and at least one memory device which stores a plurality of instructions which, when executed by the at least one processor, cause the at least one processor to operate with the at least one display device to:

enable at least one wager on at least one play of a base game, enable at least one play of a bonus secondary game, said secondary game configured to be triggered by an occurrence of a triggering event in at least one play of the base game, display a designated monetary credit meter balance, and in a first mode of operation:

(i) independent of any determined results of any plays of any base games, receive an amount of monetary funds in exchange for generation of an outcome of a random event, the amount of monetary funds associated with a first number of electronic monetary credits, (ii) determine a second number of electronic monetary credits based on the outcome of the random event, (iii) display the second number of electronic monetary credits on the designated monetary credit meter balance rather than displaying the first number of electronic monetary credits, and (iv) require at least one wager on at least one play of the base game utilizing at least one of the monetary credits of the second number of electronic monetary credits displayed on the designated monetary credit meter balance.

9. The gaming device of claim 8, which is at least one selected from the group consisting of: a mechanical reel slot machine and a video reel slot machine.

10. The gaming device of claim 8, which includes at least one input device, and wherein the plurality of instructions, when executed by the at least one processor, cause the at least one processor to operate with the at least one display device and the at least one input device to enable a player to provide data indicative of a commitment to complete a specified number of plays of the base game using at least a portion of the second number of electronic monetary credits determined in the first mode of operation based on the outcome of the random event.

11. The gaming device of claim 10, wherein the plurality of instructions, when executed by the at least one processor, cause the at least one processor to prevent the player from withdrawing any of the second number of electronic monetary credits determined in the first mode of operation based on the outcome of the random event prior to a satisfaction of the commitment.

12. The gaming device of claim 8, wherein the plurality of instructions, when executed by the at least one processor, cause the at least one processor to determine the first number of electronic monetary credits based on the amount of monetary funds received by the gaming device in the first mode of operation without increasing the designated monetary credit meter balance in response to determining said first number of electronic monetary credits.

13. The gaming device of claim 8, wherein the at least one display device includes a monetary credit meter display device for displaying the designated monetary credit meter balance and a second display device separate from the monetary credit meter display device, and wherein the plurality of instructions, when executed by the at least one processor, cause the at least one processor to display, on the second display device and not on the monetary credit meter display device, an indication of the amount of monetary funds received by the gaming device in the first mode of operation.

14. The gaming device of claim 8, wherein the outcome of the random event is determined in the first mode of operation based on a random number generated during the secondary game prior to any play of the base game.

15. The gaming device of claim 14, wherein the plurality of instructions, when executed by the at least one processor, cause the at least one processor to operate with the at least one display device to, in a second mode of operation:

(i) enable the at least one required wager on the at least one play of the base game, and (ii) if the at least one play of the base game results in an occurrence of the triggering event:

(A) generate an additional random outcome of the secondary game, and (B) display an alteration of the second number of electronic monetary credits on the designated monetary credit meter balance.

16. The gaming device of claim 8, wherein the plurality of instructions, when executed by the at least one processor, cause the at least one processor to enable a player to provide data indicative of a request to determine the designated monetary credit meter balance based on the outcome of the random event.

17. The gaming device of claim 8, wherein the second number of electronic monetary credits is determined based, at least in part, on the received amount of monetary funds.

18. A gaming system comprising:

at least one input device;

at least one display device;

at least one processor; and at least one memory device which stores a plurality of instructions which, when executed by the at least one processor, cause the at least one processor to operate with the at least one input device and the at least one display device to:

(a) display a session play monetary credit meter, (b) independent of any determined results of any plays of any base games of the gaming session, enable a player to provide a monetary payment in exchange for a play of a secondary game, (c) randomly generate at least one secondary game outcome in exchange for the provided monetary payment, (d) based on the at least one randomly generated secondary game outcome, display an initial monetary credit amount on the session play monetary credit meter, the initial monetary credit amount usable to wager on one or more plays of a base game, (e) require the player to wager at least a portion of the initial monetary credit amount on a gaming session, the gaming session including a plurality of plays of the base game provided in exchange for the wager on the gaming session, (f) in exchange for the required wager on the gaming session, determine a plurality of outcomes of the plurality of plays of the base game of the gaming session, and (g) for each of any of the plurality of determined outcomes which is associated with a non-zero award, increment the session play monetary credit meter based on said non-zero award for said one of the plurality of determined outcomes.

19. The gaming system of claim 18, wherein if any of the plurality of determined outcomes of the plurality of plays of the base game of the gaming session is associated with a triggering event, the plurality of instructions, when executed by the at least one processor, cause the at least one processor to operate with the at least one input device and the at least one display device to:

(h) randomly generate at least one additional secondary game outcome in response to the occurrence of the triggering event, and (i) increment the session play monetary credit meter based on any amount associated with the additional secondary game outcome.

20. The gaming system of claim 18, wherein the plurality of instructions cause the at least one processor to operate with the at least one input device and the at least one display device to require the player to wager all of the initial monetary credit amount on a gaming session.

21. The gaming system of claim 18, wherein the plurality of instructions cause the at least one processor to operate with the at least one input device and the at least one display device to prevent the player from withdrawing any amount displayed on the session play monetary credit meter until after a designated quantity of plays of the base game have occurred.

22. The gaming system of claim 18, wherein the plurality of instructions cause the at least one processor to operate with the at least one input device and the at least one display device to prevent the player from withdrawing any amount displayed on the session play monetary credit meter until the gaming session is finished.

23. The gaming system of claim 18, wherein the initial monetary credit amount is greater than, less than, or equal to, a designated quantity of monetary credits associated with the wager amount for the play of the bonus secondary game.

24. The gaming system of claim 18, wherein the at least one bonus secondary game amount is based, at least in part, on the monetary payment provided in exchange for the play of the secondary game.

* * * * *

UNITED STATES PATENT AND TRADEMARK OFFICE

CERTIFICATE OF CORRECTION

PATENT NO. : 8,142,272 B2
APPLICATION NO. : 11/160150
DATED : March 27, 2012
INVENTOR(S) : Jay S. Walker et al.

It is certified that error appears in the above-identified patent and that said Letters Patent is hereby corrected as shown below:

IN THE CLAIMS

In Claim 5, Column 47, Line 45, replace “the” with --a--.
In Claim 5, Column 47, Line 47, between “during” and “at” insert --the--.
In Claim 8, Column 48, Line 1, delete “bonus.”
In Claim 18, Column 49, Line 34, replace “the” with --a--.
In Claim 18, Column 49, Line 46, replace “a” with --the--.
In Claim 20, Column 50, Line 27, replace “a” with --the--.
In Claim 23, Column 50, Line 43, delete “bonus.”
In Claim 24, Column 50, Line 45, delete “bonus” and replace “amount” with --outcome--.

Signed and Sealed this
Third Day of July, 2012

David J. Kappos

David J. Kappos
*Director of the United States Patent and Trademark Office*